US007038154B2

(12) United States Patent
Höfte et al.

(10) Patent No.: US 7,038,154 B2
(45) Date of Patent: May 2, 2006

(54) DEVICE FOR REMOTELY ACTUATING A MECHANISM

(75) Inventors: Paulus Antonius Augustinus Höfte, Sint Martens Latem (BE); Gregory Clegg Spooner, Hong Kong (CN); Terence Graham Curtis, Bucks (GB); Hoss Vong, Hong Kong (CN); Leonard Joseph Keller, Jr., Cincinnati, OH (US); Thibault Fayette, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/658,007

(22) Filed: Sep. 9, 2003

(65) Prior Publication Data

US 2004/0046628 A1 Mar. 11, 2004

Related U.S. Application Data

(60) Provisional application No. 60/409,261, filed on Sep. 9, 2002.

(51) Int. Cl.
*H01H 3/20* (2006.01)

(52) U.S. Cl. ..... 200/332; 200/522

(58) Field of Classification Search ..... 200/293, 200/318, 332, 522, 43.17; 294/19.1, 19.2, 294/50.8, 50.9, 115, 116
See application file for complete search history.

(56) References Cited

U.S. PATENT DOCUMENTS 3,868,135 A * 2/1975 Magliaro ..... 294/1.5
4,014,584 A * 3/1977 Bau ..... 294/1.4
4,595,223 A * 6/1986 Hawie ..... 294/19.1
5,792,139 A * 8/1998 Chambers et al. ..... 606/41
5,868,447 A * 2/1999 Clark et al. ..... 294/1.4
6,142,715 A * 11/2000 Fontaine ..... 407/29.1
6,257,634 B1 7/2001 Wei
6,739,637 B1 * 5/2004 Hsu ..... 294/19.1

FOREIGN PATENT DOCUMENTS

| | | |
|---|---|---|
| DE | 43 22 161 A | 1/1995 |
| GB | 2 322 297 | 8/1998 |
| WO | WO 01 22861 A | 4/2001 |
| WO | WO 01 72195 A | 10/2001 |

* cited by examiner

*Primary Examiner*—Elvin G. Enad
*Assistant Examiner*—Lisa Klaus
(74) *Attorney, Agent, or Firm*—Thibault Fayette; Kim William Zerby; Steven W. Miller

(57) ABSTRACT

The present invention provides an actuating device suitable for remotely actuating a tool which can be the fluid delivery mechanism of a cleaning implement. The actuating device has a flexible tape attached at one end to a spring-loaded spool mechanism connected to a trigger where the spring loaded spool mechanism is located within a housing for holding the device. The tape is threaded through at least one pole segment and is attached to a tool which can be actuated by a pulling or pushing motion of the tape.

The present invention also provides a pair of electric cables which are attached at one end to the spring-loaded spool and at the other end to an electric tool or device such as a motor for driving a pump. An electric switch, which is located on the housing of a pistol-grip, is used to close the electric circuit formed by the pair of cables.

24 Claims, 19 Drawing Sheets

DEVICE FOR REMOTELY ACTUATING A MECHANISM

CROSS REFERENCE TO RELATED APPLICATION

This application claims the benefit of priority to U.S. Provisional Application Ser. No. 60/409,261, filed Sep. 9, 2002, which is herein incorporated by reference.

TECHNICAL FIELD

The present invention relates to self-tensioning actuating device suitable for actuating an actuable mechanism such as a fluid delivery mechanism of a cleaning implement used to clean hard surfaces.

BACKGROUND OF THE INVENTION

The literature is replete with products capable of cleaning hard surfaces such as ceramic tile floors, hardwood floors, counter tops and the like. In the context of cleaning floors, numerous mopping devices, such as cleaning implements, are described which comprise a handle attached to a mop head, a fluid delivery mechanism which can be either attached to or incorporated within the handle and a reservoir which can be used to store a cleaning composition and which is in fluid communication with the fluid delivery mechanism. These cleaning implements usually have a handle comprising at least one pole segment attached at one end to a mop head and at the other end to a hand-grip. The hand-grip can include a trigger, a switch or any other type of actuating mechanism suitable to remotely actuate the fluid delivery mechanism. The handle of these implements can be made of one or more pole segments. Cleaning implements having a single pole are usually sold already preassembled to consumers. As a result, these implements are relatively inconvenient to ship due to their volume, and require a significant shelving space when displayed in stores. In contrast, cleaning implements having a plurality of pole segments can be sold to consumers partially disassembled with instructions to the users allowing them to properly assemble the implement. These implements can be packed such that they are easier and less costly to ship. Conveniently, these implements occupy less shelving space in the stores. One problem with cleaning implements having segmented poles is that when a user either squeezes a trigger or pushes on an electric switch, the "actuation signal" required to activate a fluid delivery mechanism still needs to be conveyed along each piece of pole down to the fluid delivery mechanism.

Attempts have been made to assure a good conveyance of the "actuation signal." For example, International Application serial No PCT/US01/09498 to Hall et al, filed Mar. 23, 2001, and assigned to the Clorox Company, describes a cleaning implement having a multi-segmented pole or handle, a fluid delivery mechanism and a hand-grip having a trigger mechanism. Each segmented pole comprises a push rod located within each pole. Once a user connects each segmented pole to form the handle, actuation of the trigger results in the motion of a first push rod. The motion of this first push rod is transferred to the immediately adjacent push rod down to the liquid delivery mechanism. This mechanism requires the use of the same number of push rods as the number of pole segments which can render the whole assembly heavy which, in turn, results in added manufacturing and shipping costs.

Another type of cleaning implement is described in International Application serial No PCT/US00/26384 to Kunkler et al, filed Sep. 26, 2000, and assigned to The Procter and Gamble Company. The cleaning implement comprises a multi-segmented pole, a fluid delivery mechanism (which can comprise batteries, a motor and a pump) and a hand-grip having an electrical switch. Each segmented pole comprises a pair of electric cables attached to electric connectors at each end of the segmented poles. Once a user connects each segmented poles to form the handle, actuation of the switch results in the electrical circuit being closed which, in turn, actuates a motor and a pump. Electric connectors can increase the manufacturing cost and can render the manufacturing process more complex.

Other types of cleaning implements comprise a fluid delivery mechanism remotely connected to a trigger via a cable. In these implements, the pulling of the cable results in the actuation of the fluid delivery mechanism. If this type a cleaning implement having a continuous cable, comprises a disassembled multi-segmented pole, the length of the cable needs to be increased such that each pole segment can be "folded" in order for the implement to fit in a smaller package. When a user assembles the cleaning implement by connecting each pole segment, the extra length of cable at each fold point results in slackness in the cable renders the actuation of the fluid delivery mechanism more difficult as the cable which needs to be tensioned to convey the actuation signal. As a result, implements comprising a continuous cable are typically sold preassembled rather than disassembled. This can cause additional problems for the user since the cable must be manually tensioned and affixed to the fluid delivery mechanism.

While the problem associated with tools, such as cleaning implements, having a multi-segmented pole and a mechanism which needs to be remotely actuated, has been addressed, there remains a need for an inexpensive self-tensioning actuating device suitable with a multi-segmented pole and which allows a user to assemble and then remotely actuate a mechanism such as a fluid delivery mechanism.

It is therefor an object of this invention to provide a self-tensioning actuating device suitable for remotely actuating a mechanism such as the fluid delivery mechanism of a cleaning implement.

SUMMARY OF THE INVENTION

The present invention relates to actuating devices suitable for remotely actuating a tool. In one embodiment, the actuating device can have a flexible tape attached at one end to a spring-loaded spool mechanism connected to a trigger where the spring loaded spool mechanism is located within a housing for holding the device. In a preferred embodiment, the tape can be threaded through at least one pole segment and be attached to a tool which can be actuated by a pulling or pushing motion of the tape. In another embodiment, a pair of electric cables can be attached at one end to the spring-loaded spool and at the other end to an electric tool or device. An electric switch located on the housing can be used to close the electric circuit formed by the pair of cables.

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

DETAILED DESCRIPTION OF THE INVENTION

Figure 1:
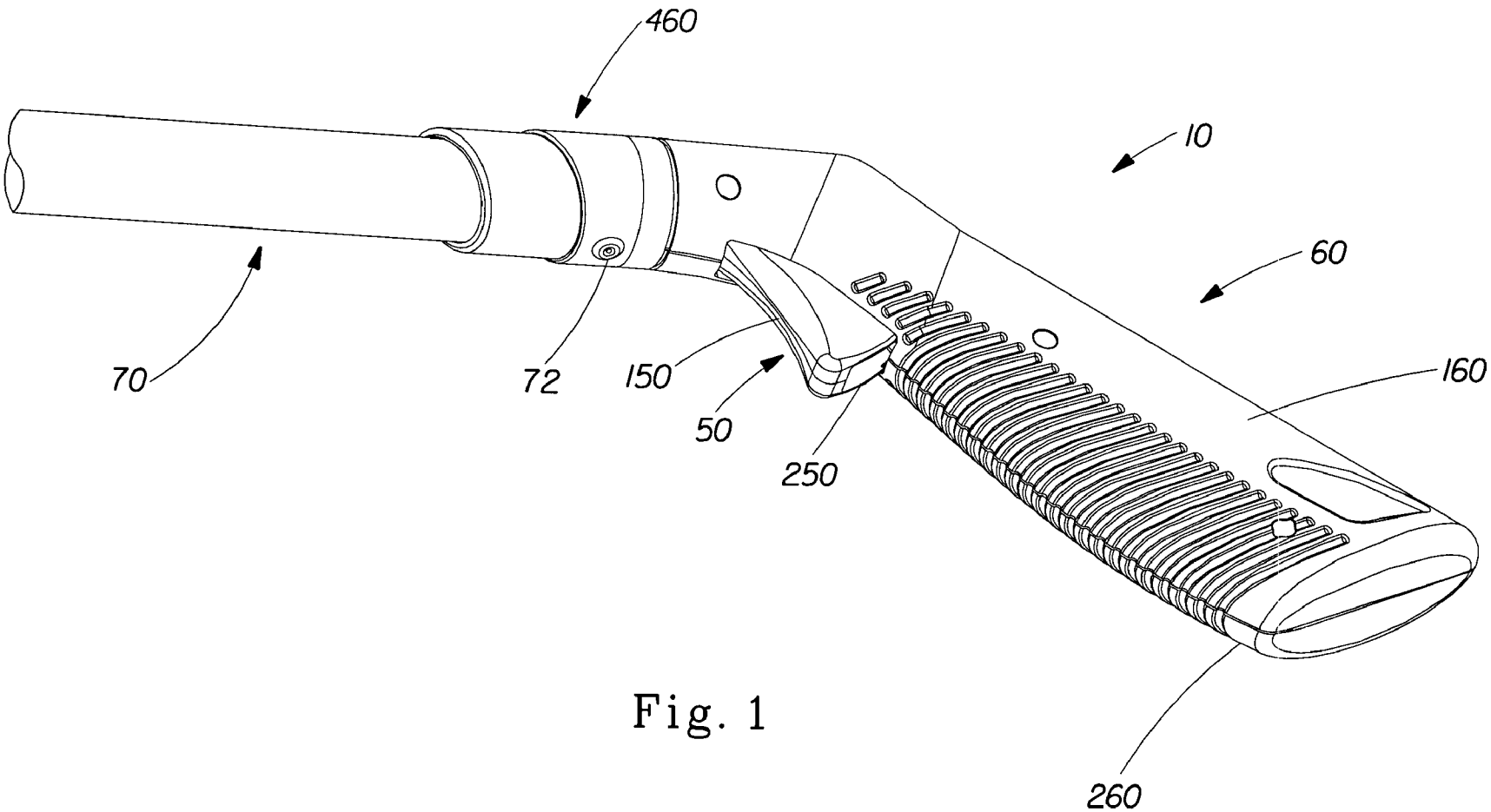
FIG. 1 is an isometric view of one embodiment of the present invention.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements.

I. Definitions

As used herein, the term "actuating device" means a device preferably located at one end of a handle comprising at least one pole segment and capable of remotely actuating an actuable mechanism distally located on this handle.

As used herein, the term "actuable mechanism" means any mechanism in need of being remotely actuated such as a fluid delivery mechanism.

II. Actuating Mechanism

Figure 2:
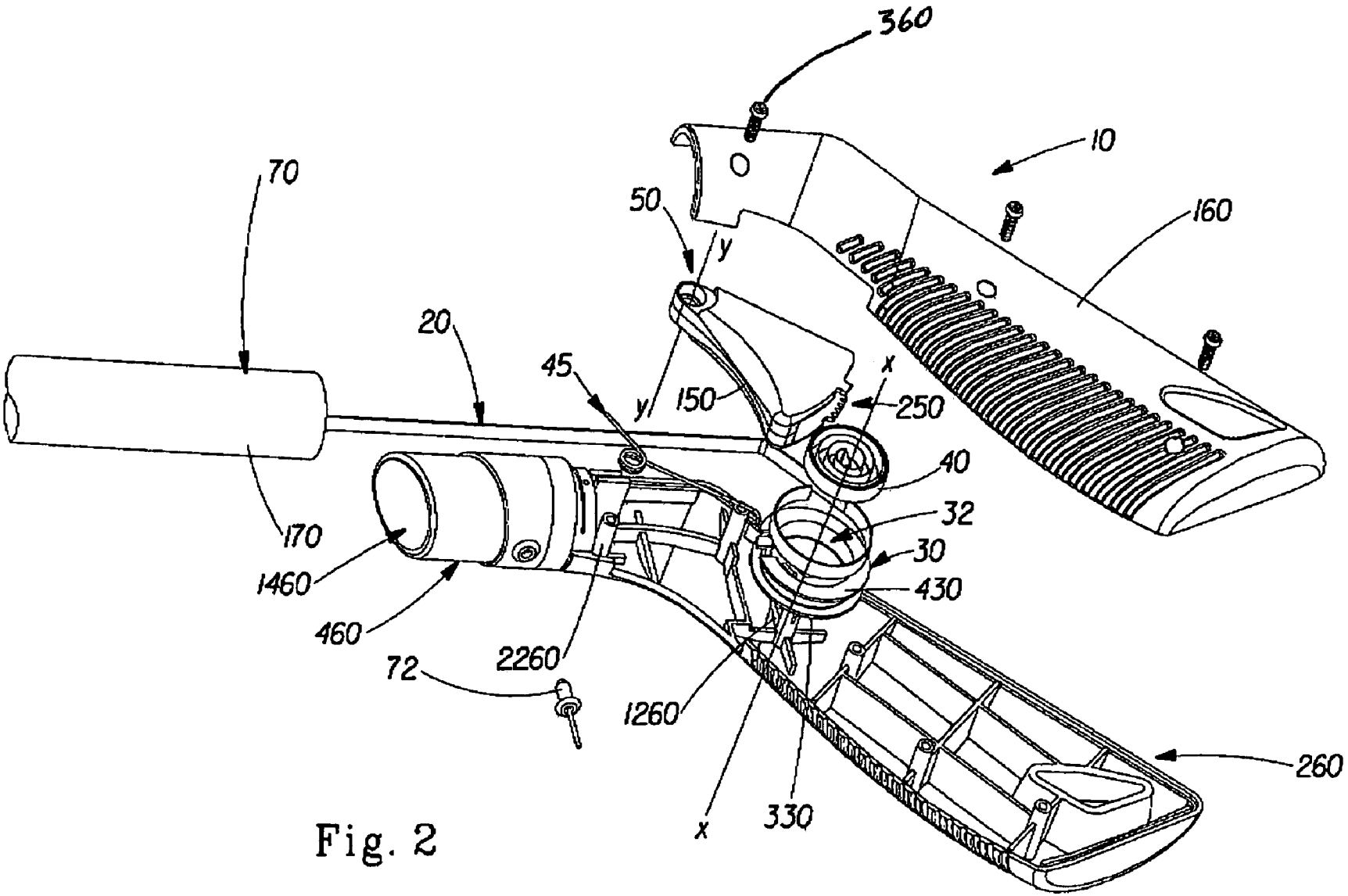
FIG. 2 is an exploded view of the embodiment shown in FIG. 1.

Referring to FIGS. 1 and 2, for clarity purposes, a portion of a device (hereinafter "actuating device") for remotely actuating a mechanism is represented.

In one embodiment, the actuating device 10 comprises a substantially longitudinal member 20 having a first end and a second end, a winding member 30 having a rotational X—X axis, a spring member 40, a means 50 for rotating the winding member 30, a housing 60 and at least one pole segments 70.

In one embodiment, the housing 60 can comprise, for ease of assembly, a left side 60 and an opposing right side 260 which can be attached via: screws 360, clips, adhesive, or heat sealed once assembled. The left and right sides 160, 260, define an inner cavity where functional members can be located. The housing 60 can have any shape suitable for the hand(s) of a user. In a preferred embodiment, the housing 60 is ergonomically shaped and can have, for example, a pistol grip shape in order to allow the user to conveniently hold and actuate the device with either the left or right hand. The housing 60 can have a connecting portion 460 which can have an appropriate cylindrical shape for engaging and/or being engaged by the first end of a pole segment 70 having a matching shape. One skilled in the art will understand that the connecting portion can have a different shape. Non limiting examples of suitable cross-sectional shapes can be triangular, rectangular or, more generally, polygonal but it can be preferred that the connecting portion have substantially the same geometric shape as the pole segment 70. A pole segment 70 can be made of any material capable of supporting the pressure applied directly or indirectly by a user or by an actuable mechanism attached to a pole segment. Non-limiting examples of materials suitable for a pole segment can be plastic, wood metal or any combination thereof. In a preferred embodiment, each pole segment is made of aluminum. In a preferred embodiment, each pole segment is substantially hollow, i.e. tubular, such that a longitudinal member 20 can be threaded through each pole segment. In one embodiment, a pole segment 70 can be attached to the housing 60 by being inserted within the connecting portion 460 through a slit or opening 1460. A rivet member 72 can be used to maintain the pole segment 70 attached to the housing 60 via the connecting portion 460 but the skilled artisan will understand that the pole segment can also be forced fit, screwed, adhesively attached or even molded with the housing 60 as a single element and provide the same benefits. In one embodiment, the opposing right side 260 of the housing can have a first protrusion 1260 where the first end of spring member 40 can be attached, for example via a slit made in the protrusion 1260. The second end of the spring member 40 can be attached to the winding member 30 such that rotation of the winding member 30, for example clockwise, will result in an opposite reacting force from the spring member 40 "trying" to rotate the winding member 30 counter clockwise. In a preferred embodiment, the winding member 30 has a substantially cylindrical shape but one skilled in the art will understand that the winding member 30 can have different shape and still provide the same benefits. The winding member 30 has an inner radius r, an outer radius R and a width W. In a preferred embodiment, the winding member 30 is sized such that it can be located within the housing 60. In a preferred embodiment, the inner radius r is comprised between about 3 mm and about 30 mm, and about 20 mm preferably between about 5 mm, the outer radius R is comprised between about 4 mm and about 35 mm, preferably between about 7 mm and about 22 mm and the width W is comprised between about 1 mm and about 10 mm, preferably between about 2 mm and 7 mm.

In one embodiment shown in FIG. 2, the spring member 40 can be a coil spring having a first end, or inner end, attached to the protrusion 1260 and a second end, or outer end, attached to the inner surface 32 of the winding member 30. In one embodiment, the rotational axis X—X of the winding member 30 substantially coincides with the longitudinal axis of the protrusion 1260 of the opposing right side 260 of the housing 60. In a preferred embodiment, the winding member 30 is capable of rotating about the longitudinal axis of the protrusion 1260. One skill in the art will understand that it is possible to measure the rotation of the winding member in radians taking as a reference the location where the second end of the coil spring 40 is attached to the inner surface of the winding member 30. For example, the coil spring at rest is equivalent to 0 degrees, half a turn is equivalent to 180 degrees, one turn is equivalent to 360 degrees and 2 turns are equivalent to 720 degrees. The coil spring 40 can be made of any material which provides resiliency when it is deformed. Non-limiting examples of such material comprise metals such as cold drawn, hardened and tempered carbon steel, alloy steel, corrosion resisting stainless steel or nonferrous alloys, and elastomeric materials. In a preferred embodiment, the coil spring 40 is made of stainless steel and can have a total length comprised 10 cm and about 100 cm when it is completely stretched. In one embodiment, the coil spring is such that it is possible to rotate the winding member of at least 45 degrees, preferably at least 180 degrees, more preferably at least 720 degrees and most preferably at least 1080 degrees. One skilled in the art will understand that whenever a calculation requires the use of radians rather than degrees, $\pi$ radians equals 180 degrees.

In one embodiment, the means 50 for rotating the winding member can be a trigger member which can be movably attached about a rotational axis Y—Y to the left and/or opposing right sides 160, 260 of the housing 60 with a second protrusion 2260 extending for example, from the opposing right side 260 through an opening in the trigger 50. One skilled in the art will understand that the trigger 50 can comprise a protrusion extending through an opening in the right and/or left side 160, 260. In a preferred embodiment, the trigger member 50 can be located adjacent the lower portion of the housing but the trigger member 50 can be located in a different portion of the housing 60, such as for example the top portion of the housing 60 and still provide the same benefits. A spring element 45 can be attached to the trigger member 50 such that when a user stops applying pressure on the trigger member 50, the trigger member 50 comes back to its original position. The housing 60, the winding member 30 and the trigger member 50 can be made of any kind of material such as metal(s), plastic(s), wood(s) or any combination thereof. In a preferred embodiment, the left and right sides 60, 260 of the housing 60 are made of Copolymer Polypropylene, the winding member 30 and the trigger member 50 are made of Polyoxymethylene.

Figure 3:
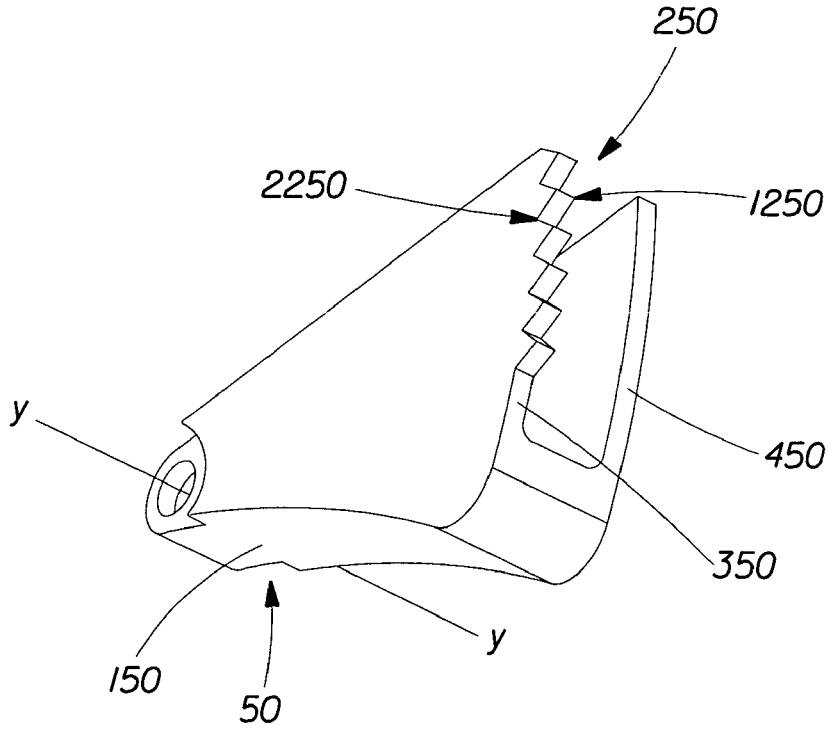
FIG. 3 is an isometric view of a trigger member of the present invention.
Figure 4:
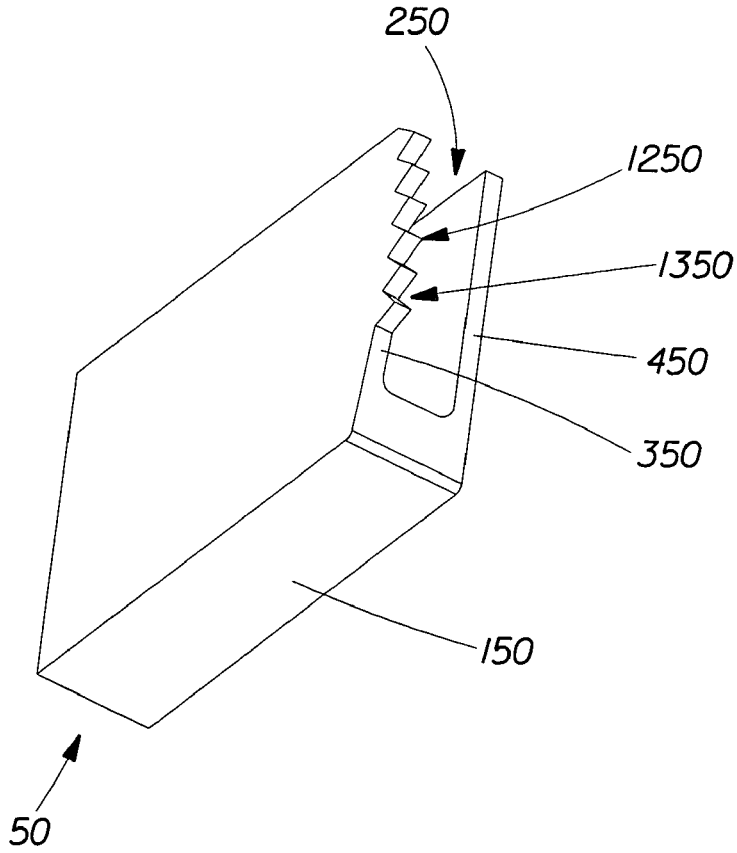
FIG. 4 is an isometric view of another trigger member of the present invention.

Referring to FIG. 3, the body of the trigger member 50 can have an actuating surface 150 where the user can apply pressure, and at least one motion transferring surface 250 which can be located on a side portion 350 of the trigger member 50 and which extends from the actuating surface 150. The motion transferring surface 250 is such that it can "transfer" the motion of the trigger member 50 to the winding member 30. One skilled in the art will understand that when the user actuates the trigger by applying pressure on the actuating surface 150, the trigger member 50 can rotate about the rotational axis Y—Y. The motion transferring surface 250 can have a substantially arcuate shape. In one embodiment, the motion transferring surface 250 comprises a plurality of projections 1250 with spaces 2250 in between for engaging corresponding spaces and projections on the winding member 30. In a preferred embodiment, the trigger member 50 can comprise a first and a second side portion, respectively 350 and 450 where at least one of these side portions comprises a motion transferring surface 250 having projections 1250. One skilled in the art will understand that actuation and thus partial rotation of the trigger member 50 for example counter clockwise will result in the clockwise rotation of the winding member 50 once at least one projection 1250 of the actuating portion engages a space 130 of the winding member 30. In another embodiment represented in FIG. 4, a trigger member 50 can have an actuating surface 150 and a substantially flat motion transferring surface 250 having projections 1250. This trigger member 50 can be slidably attached to the housing 60 such that when the trigger member 50 is axially displaced within the housing 60, at least some of the projections 1250 engage some spaces 130 of the winding member 30.

Figure 5:
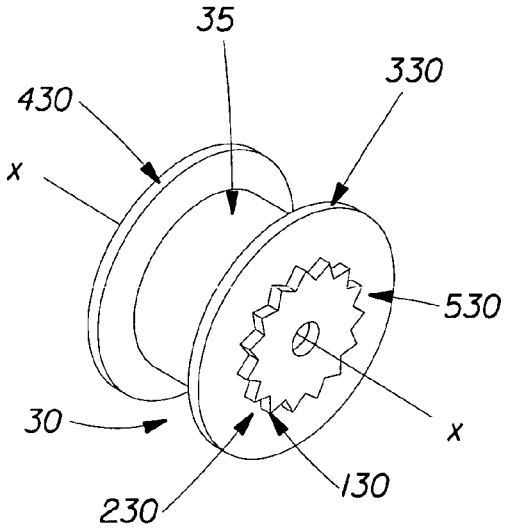
FIG. 5 is an isometric view of a winding member of the present invention.
Figure 6:
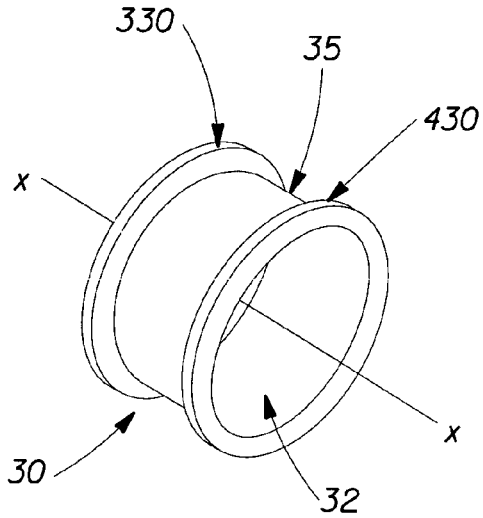
FIG. 6 is an isometric view of the opposite side of the winding member of FIG. 5.

In one embodiment shown in FIGS. 5 and 6, the winding member 30 can have at least one but preferably two ridges 330 and 430 extending outwardly from the side edges of the outer surface 35 and defining a space in between for receiving the longitudinal member 20. In one embodiment, at least one of the ridges 330, 430 can comprise a plurality of projections 130 extending radially as well as spaces 230 being engageable by the corresponding spaces and projections 1250 and 2250 located on the motion transferring surface 250 of the trigger member 50. In one embodiment, the distance between the first and the second side portions 350, 450 can be substantially equal to the width of the winding member 30 such that the projections 1250 of the motion transferring surface 250 are capable of engaging the spaces 230 located on the ridge(s) 330, 430 of the winding member 30.

Figure 7:
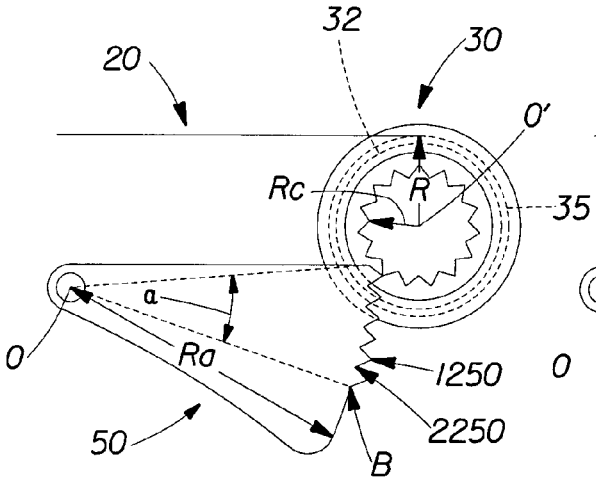
FIG. 7 is a schematic front view of a trigger member and a winding member of the present invention when the trigger member is not being actuated.
Figure 8:
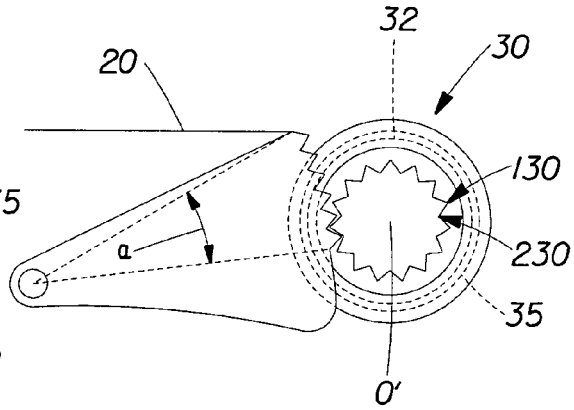
FIG. 8 is a schematic front view of the trigger member and the winding member of FIG. 7 when the trigger member is being actuated.

One skilled in the art will understand that the projections and spaces 130, 230 of the winding member 30 can be located anywhere on the winding member 30 as long as these are engageable by the corresponding spaces and projections 1250, 2250 of the motion transferring surface 250 of the trigger member 50. In a preferred embodiment shown in FIG. 5, the winding member 30 can comprise at least one gear member 530. The gear member 530 can have a substantially cylindrical shape and comprising a plurality of projections 1530 extending radially with spaces in between 2530 for respectively engaging and being engaged by the spaces 2250 and projections 1250 on the motion transferring surface 250 of the trigger member 50. The gear member 530 is preferably attached to the winding member 30 such that it extends outwardly from the winding member 30. In a preferred embodiment, the rotational axis of the gear member 530 substantially coincides with the rotational axis X—X of the winding member 30. The gear member can either be attached to the winding member but is preferably molded with the winding member as a single element. In a preferred embodiment, the radius of the gear member 530 is less than the radius of the winding member 30. In this embodiment, it can be preferred that the distance between the first and the second side portions 350, 450 be greater than the width of the winding member 30 such that the projections of the motion transferring surface 250 are capable of engaging the spaces 2530 of the gear member 530. Without intending to be bound by any theory, it is believed that the trigger member 50 having projections 1250 and the winding member 30 having projections 130 or 1530 can be viewed as a rack interacting with a pinion. One skilled in the art will understand that, as with any gear mechanism, the amplitude of the rotation of the winding member 30, which is caused by the actuation of the trigger member 50, is related to the length or "Arc length" of the portion of the motion transferring surface 250 comprising projections and spaces 1250, 2250 as well as the length or "Circular length" of the portion of the winding member 30 comprising the corresponding spaces and projections 230 or 2530 and 130 or 1530. It is possible to calculate the "Arc length" (herein after Al) of the portion of the motion transferring surface 250 with the following formula $Al=\alpha\times Ra$ where $\alpha$ is the closed angle between the two segments OA and OB and Ra is the radius of the circle having for center the point O and which passes through the points A and B. As represented in FIGS. 6 and 7, O is located on the rotational axis Y—Y of the trigger member 50, A is the point where the first projection or space 1250, 2250 can be found on the motion transferring surface 250 and B is the point where the last projection or space 1250, 2250 can be found on the motion transferring surface 250. It is also possible to evaluate the "Circular length" (herein after Cl) of the portion of the winding member 30 comprising projections and spaces 130 or 1530 and 230 or 2530 with the following formula $Cl=\beta\times Rc$ where $\beta$ is the closed angle between the two segments O'C and O'D and Rc is the radius of the circle having for center the point O' and which passes through the points C and D (not shown). O' is located on the rotational axis X—X of the winding member 30, C is the point where the first projection or space can be found on the winding member 30 and D is the point where the last projection or space can be found on the winding member 30. In a preferred embodiment, the projections and spaces are located all around the winding member 30 or the gear member 530, i.e. the points C and D have the same location. Among other benefits, having projections and spaces located all around the winding member 30 or gear member 530 allows the trigger member 50 to engage and rotate the winding member independently of the position of the winding member 30. In this embodiment, one skilled in the art will understand that the angle $\beta$ is equal to 360 degrees (i.e. $2\pi$ radians) and that, as a result, the "circular length" Cl only depends on Rc. Once the values of Al and Cl are determined, it is possible to calculate the number of "turns" made by the winding member 30 when the trigger member is fully actuated as shown in FIG. 8. The number of turns (herein after Nt) is given by the following formula $$Nt = \frac{Al}{Cl} = \frac{\alpha \cdot Ra}{\beta \cdot Rc}$$

and when $\beta=2\pi$, then $$Nt = \frac{\alpha}{2\pi} * \frac{Ra}{Rc}.$$

One skilled in the art will understand that for a given value of Ra, the greater $\alpha$ and/or the smaller Rc, the more number of turns will be made by the winding member 30.

In one embodiment, the first end of the longitudinal member 20 can be attached to the outer surface 35 of the winding member 30 and the second end can be attached to an actuable mechanism 80 which will be described subsequently. The longitudinal member 20 can be made of one or more cable(s), wire(s), rope(s), ribbon(s) and/or a tape(s) and can be made of any substantially flexible material such that when the winding member 30 is rotated, the longitudinal member 20 winds itself up on the outer surface of the winding member 30. Non-limiting examples of suitable material includes metal such as steel wire-rope, plastics such as nylon ribbon or tape, PVC, natural and/or synthetic fibers such as cotton, polyamide, PP which can be woven or nonwoven, as well as carbon, metal or glass-fiber re-inforced materials. When the number of turns Nt is known, it is possible to calculate what length of the longitudinal member 20 is rolled up or released when the trigger member 50 is actuated. Since the longitudinal member 20 is either rolled up onto and/or released from the outer surface of the winding member 30, the length La of the longitudinal member 20 being rolled up and/or released is substantially equal to $2\pi.Nt.R$ where R is the radius of the outer surface 35 of the winding member 30 and considering that the thickness of the longitudinal member 20 is negligible for the evaluation of La and that the contact between the trigger member 50 and the gear member 530 is substantially tangential. Conversely, when a predetermined length La of the longitudinal member 20 is desired or required to actuate a remotely located actuable mechanism 80, it is possible to calculate and adjust one or more of the following parameters R, Ra, Rc and $\alpha$. In one embodiment, La is comprised between about 1 mm and about 100 mm, preferably between about 2 mm and about 50 mm, even more preferably between about 2 mm and about 25 mm. In one embodiment, R is comprised between about 1 mm and about 40 mm, preferably between about 2 mm and about 20 mm, even more preferably between about 2 mm and about 15 mm. In one embodiment, Ra is comprised between about 1 mm and about 80 mm, preferably between about 10 mm and about 60 mm, even more preferably between about 20 mm and about 50 mm. In one embodiment, Rc is comprised between about 1 mm and about 40 mm, preferably between about 1 and about 20 mm, even more preferably between about 2 mm and about 10 mm. In one embodiment, $\alpha$ is comprised between about 1° and about 80° preferably between about 5° and about 45°, even more preferably between about 10° and about 30°.

In a preferred embodiment, the longitudinal member 20 is attached to the outer surface 35 of the winding member 30 between the two ridges 330 and 430 such that the longitudinal member 20 can be rolled up on the outer surface 35. In one embodiment, the longitudinal member 20 is capable of "carrying" a load of at least 100 grams, preferably at least 1 kg, more preferably at least 5 kg and most preferably at least 20 kg without rupturing and/or without substantial deformation. In a preferred embodiment, the longitudinal member 20 is a tape made of woven nylon fibers, having a length of at least about 110 cm, a width of at least about 4 mm and is capable of "carrying" a load of at least about 25 kg. When the tape 20 is rolled one or more turns on the outer surface of the winding member 30 and then the coil spring 40 is attached to the inner surface of the winding member, the tape 20 can be pulled. The pulling of the tape results in a reacting force from the coil spring as previously described. When the tape is released, the reacting force of the coil spring rolls the tape back on the outer surface of the winding member until it reaches a rest position and/or an equilibrium. One skilled in the art will understand that the same result can be achieved when the coil spring is "pre-loaded" and then attached to the protrusion 1260 of the right potion 260 and to the inner surface of the winding member 30. If the force applied to the tape is greater than the recoil force of the spring, the tape will be de-rolled. If the force applied to the tape is equal to the recoil force of the spring, there is an equilibrium. If the force is smaller than the recoil force of the coil spring 40, the tape 20 is rolled back on the outer surface of 35 the winding member 30.

One skilled in the art will understand that depending on the direction of the reacting force of the coil spring 40 on the winding member and depending in which direction the tape 20 is rolled on the winding member 30, actuation on the trigger member 50 will result in the tape being pulled or released.

In one embodiment, represented in FIGS. 7 and 8, the actuation, i.e. rotation, of the trigger member is counter-clockwise, the reacting force of the coil spring is clockwise and the tape is also rolled up clockwise on the winding member. In a preferred embodiment, the recoil force of the coil spring 40 is less than the force necessary to actuate the actuable mechanism with the tape 20 but the recoil force is sufficient to wind up any extra length of tape until the tape is tensioned between the actuable mechanism and the winding member 30. When the trigger 50 is at rest, i.e. not being actuated, the tape 20 which can be connected at its lower end to an actuable mechanism is put under tension by the coil spring 40 and the system is at an equilibrium. Once a user actuates the trigger member 50 as schematically represented in FIG. 7, the trigger member 50 rotates counter clockwise resulting in the clockwise rotation of the cylindrical. Because of the combined action of the trigger member 50 and the coil spring 40 on the tape 20, the tape is being further rolled up on the winding member 30 (or extracted from the pole segment) and can activate the actuable mechanism by pulling on it. Once the user releases the trigger member 50, the tape 20 can progressively return to its original position when the force applied by the actuable mechanism on the lower end of the tape exceeds the coil spring recoil force and until the equilibrium has been reached. This configuration can also be used to actuate an actuable mechanism which requires a "pushing" motion rather than a pulling motion. The free end of the tape 20, i.e. the second end of the longitudinal member, can be looped around a pin or axial member which can be attached at a lower position than the actuable mechanism such that the tip of the loop is also at a lower position than the actuating member of the actuable mechanism. When the tape is pulled, i.e. rolled up on the outer surface 35 of the winding member 30, a force having an opposite direction is then applied to the actuable mechanism.

Figure 9:
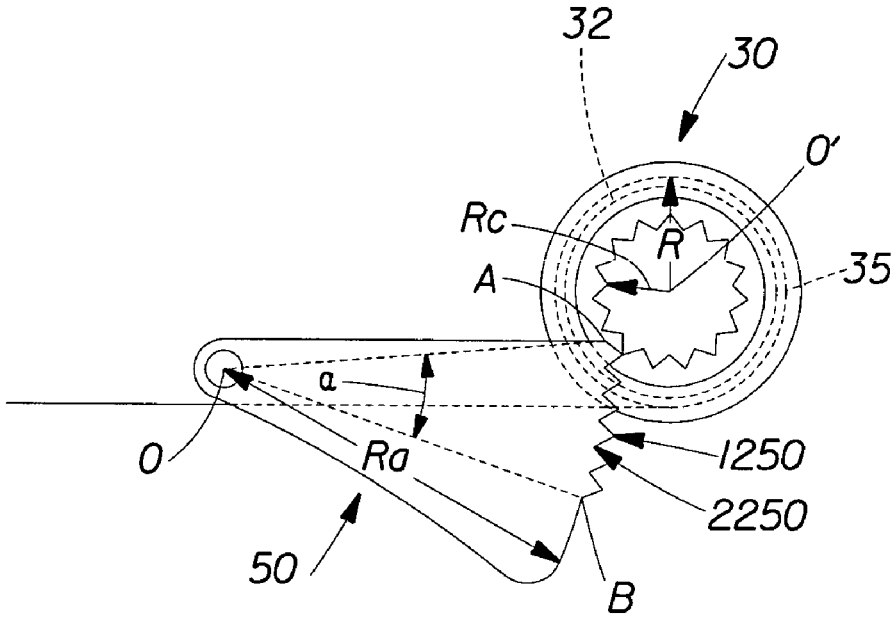
FIG. 9 is a schematic front view of another embodiment of the invention having a trigger member and a winding member when the trigger member is not being actuated.
Figure 10:
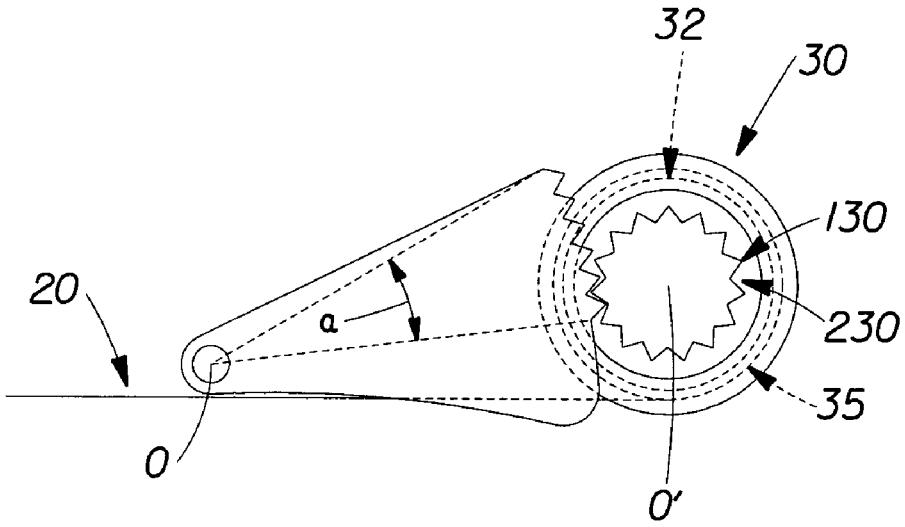
FIG. 10 is a schematic front view of the trigger member and the winding member of FIG. 9 when the trigger member is being actuated.

Referring to FIGS. 9 and 10, the action of the trigger member 50 and coil spring 40 on the winding member 30 and thus the tape 20 is schematically represented, where the rotation of the trigger member 50 is counter clockwise, the reacting force of the coil spring is counter-clockwise and the tape is also rolled up counter-clockwise on the winding member. When the trigger member 50 is not being actuated, the tape 20, which can be connected at its lower end to an actuable mechanism, is put under tension by the coil spring 40 and the system is at an equilibrium. Once a user actuates the trigger member 50 and the amount of force applied to the trigger member 50 exceeds the recoil force of the coil spring 40, the trigger member 50 rotates counter clockwise resulting in the clockwise rotation of the winding member 30. As a result a portion of the tape is being released from the winding member 30 and can activate the actuable mechanism. Once the user releases the trigger member 50, the tape 20 can progressively return to its original position when the recoil force applied by the coil spring on the tape exceeds the force applied by the actuable mechanism and until the equilibrium has been reached.

Figure 11A:
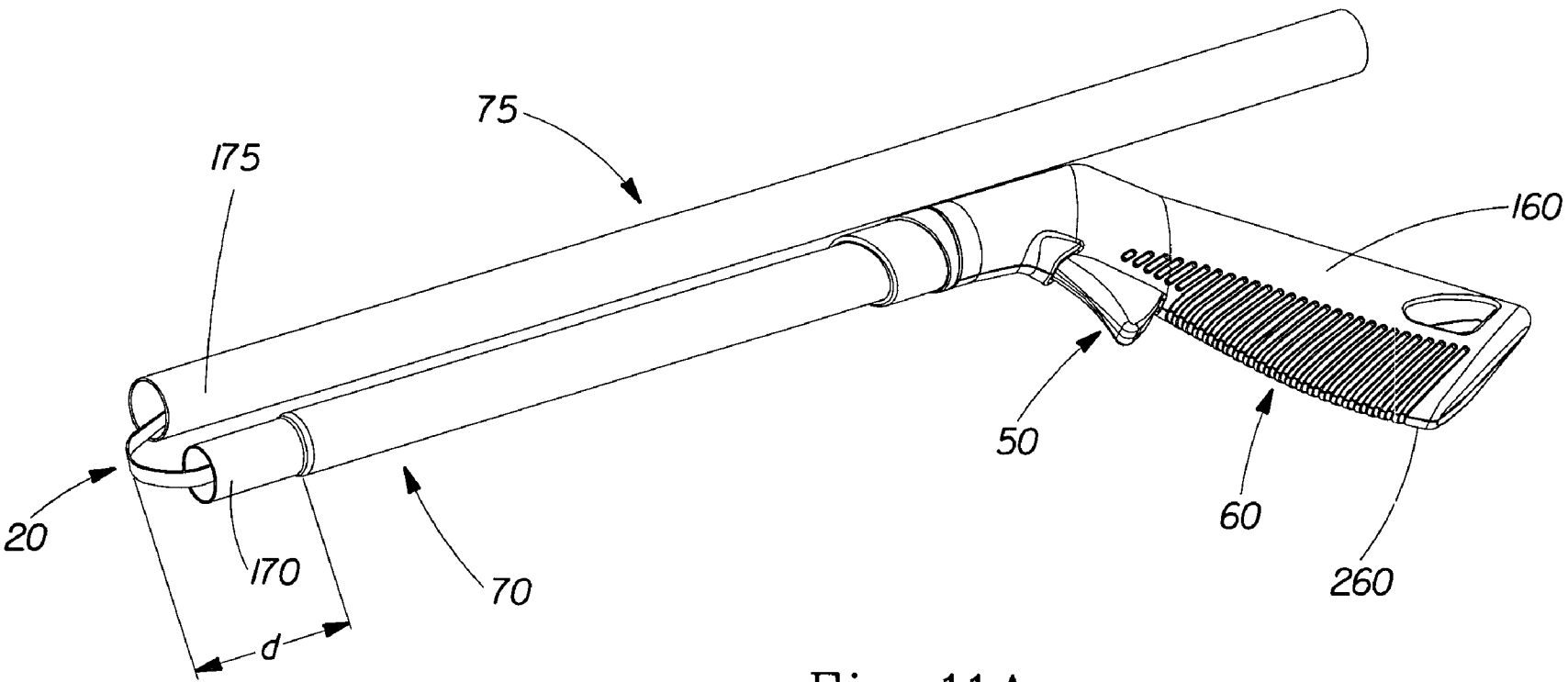
FIG. 11A is an isometric view of one embodiment of the present invention where two pole segments are "folded"
Figure 11B:
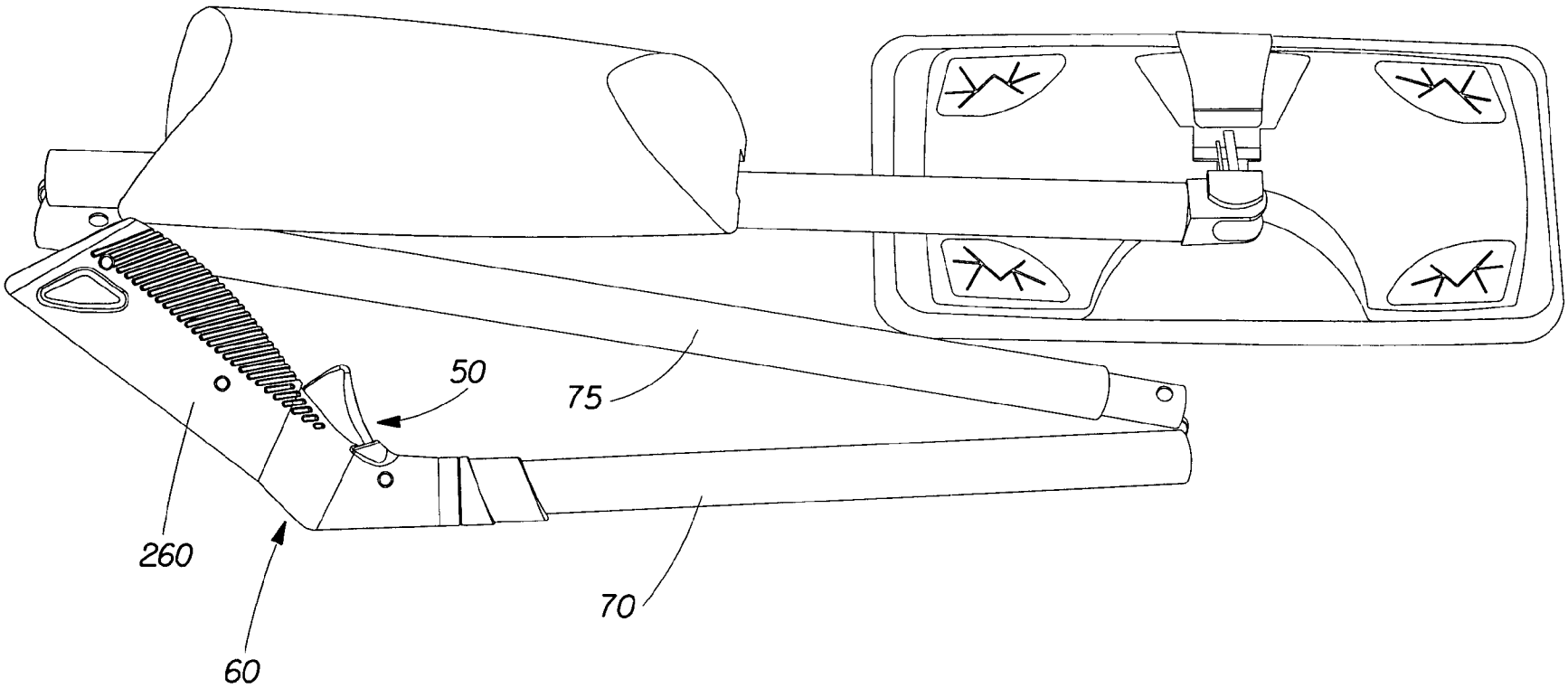
FIG. 11B is an isometric view of a one embodiment of the present invention where three pole segments are "folded"

Referring to FIGS. 11A and 11B, a device for remotely actuating a mechanism, and having two "folded" pole segments, is represented. FIG. 11A shows the device of the present invention in association with pole elements folded for packaging, shipping or storage. Multiple pole elements can be joined to provide, for example, the handle of a cleaning implement-having a controllably actuable fluid delivery mechanism as shown in FIG. 11B. For purposes of illustration, only one fold point is shown, although a typical handle may comprise multiple pole elements, resulting in multiple fold-points. As can be seen from the figure, the overall length of longitudinal member 20 is preferably slightly in excess of its actuating length by distance d to allow folding to occur. Once the handle is assembled by inserting the male portion of a pole segment into the female portion of another pole segment, the excess length d of the longitudinal member 20 necessitated by the fold point (or fold points), as well as the insertion of the male portion into the female portion, will result in slackness in member 20, whereby member 20 is of no use in actuating the fluid delivery mechanism. This slackness is taken-up, and tension is thereby restored to member 20, by the tensioning action of the device herein.

In one embodiment, the actuating device 10 can have at least 2 pole segments 70, 75 which can be removably or permanently attached to each other by a user. In one embodiment, the actuating device 10 can have between 1 and 10 pole segments having a substantially tubular shape having a length comprised between about 10 cm and about 100 cm and an inner diameter comprised between about 10 mm and about 40 mm. In one embodiment, the longitudinal member 20 is threaded through the first pole segment 70 and the second segment 75. In a preferred embodiment, the first end 170 of the first pole segment 70 can be permanently attached to the housing 60 as previously described. In another embodiment, the first end 170 of the first pole segment 70 is removably attachable to the housing 60. The second end 270 of the first pole segment 70 can be permanently or removably attached to the first end 175 of the second pole segment 75. In one embodiment, the second end 170 of a first pole segment 70 can have a male portion 1170 for engaging the female portion 1175 of the first end of the second pole segment 75. By "male portion" and "female portion", it is meant that the end of one pole segment (male portion) can engage, i.e. penetrate at least partially, the end of another pole segment (female portion). A suitable example of a pole segment having a male portion for engaging a female portion of another pole segment is disclosed in U.S. application Ser. No. 60/323,777 to Clare et al., filed Sep. 20, 2001 and assigned to The Procter and Gamble Company. In another embodiment represented in FIGS. 12, 13 and 14, the male portion of a pole segment can also have a locking member 90. The locking member 90 can be any type of spring clip known in the art and can be made of metal or plastic(s). In a preferred embodiment, the locking member 90 is made of Polyoxymethylene. In a preferred embodiment, represented in FIGS. 12 and 13, the locking member 90 can have a substantially cylindrical body 190 which can be inserted within the male portion 1170 of a pole segment 70. The cylindrical body 190 can have a resilient protrusion 290 which extends through an opening 2170 on the male portion 1170 and is also capable of extending at least partially but preferably completely through an opening 2175 on the female portion 1175 as shown in FIG. 14. When a user wants to assemble two pole segments together, the user can simply insert the male portion 1170 with the locking member 90 of a first pole segment 70 within the female portion 1175 of a second pole segment 75. The resilient protrusion member 290 can be deflected when pressure is applied on it. Once the opening 2175 on the female member 1175 faces the resilient protrusion member 290, the protrusion member 290 extends at least partially through the opening 2175 and locks the two pole segments together by preventing further axial motion and/or rotation of the pole segments. In another embodiment, the cylindrical body 190 can have a stopping member 390 which can have the shape of an annular ridge radially extending from one end of the cylindrical body 190. Without the stopping member 390, a locking member 90 could accidentally slide within a pole segment and it can then be difficult to recover the locking member 90. This stopping member can prevent the locking member from accidentally sliding within a pole segment. In a preferred embodiment, the diameter of the stopping member is smaller than the inner diameter of the pole member 75. The locking member can be made of any suitable material providing some resiliency to the protrusion member. Non-limiting examples of suitable materials can be metals, alloys, plastics, wood and any combination thereof. Among other benefits, the foregoing locking member 90 allows to permanently or removably attach two pole segments but it also allows the longitudinal member 20 to be threaded through the locking member 90 while limiting the frictions on the longitudinal member 20 when it is displaced within a series of pole segments. One skilled in the art will understand that more than two pole segments can be consecutively attached using the previously described locking member 90 and that a pole segment can at one end either a male or a female portion in order respectively to engage a female portion or be engaged by a male portion at one end of another pole segment.

Figure 12:
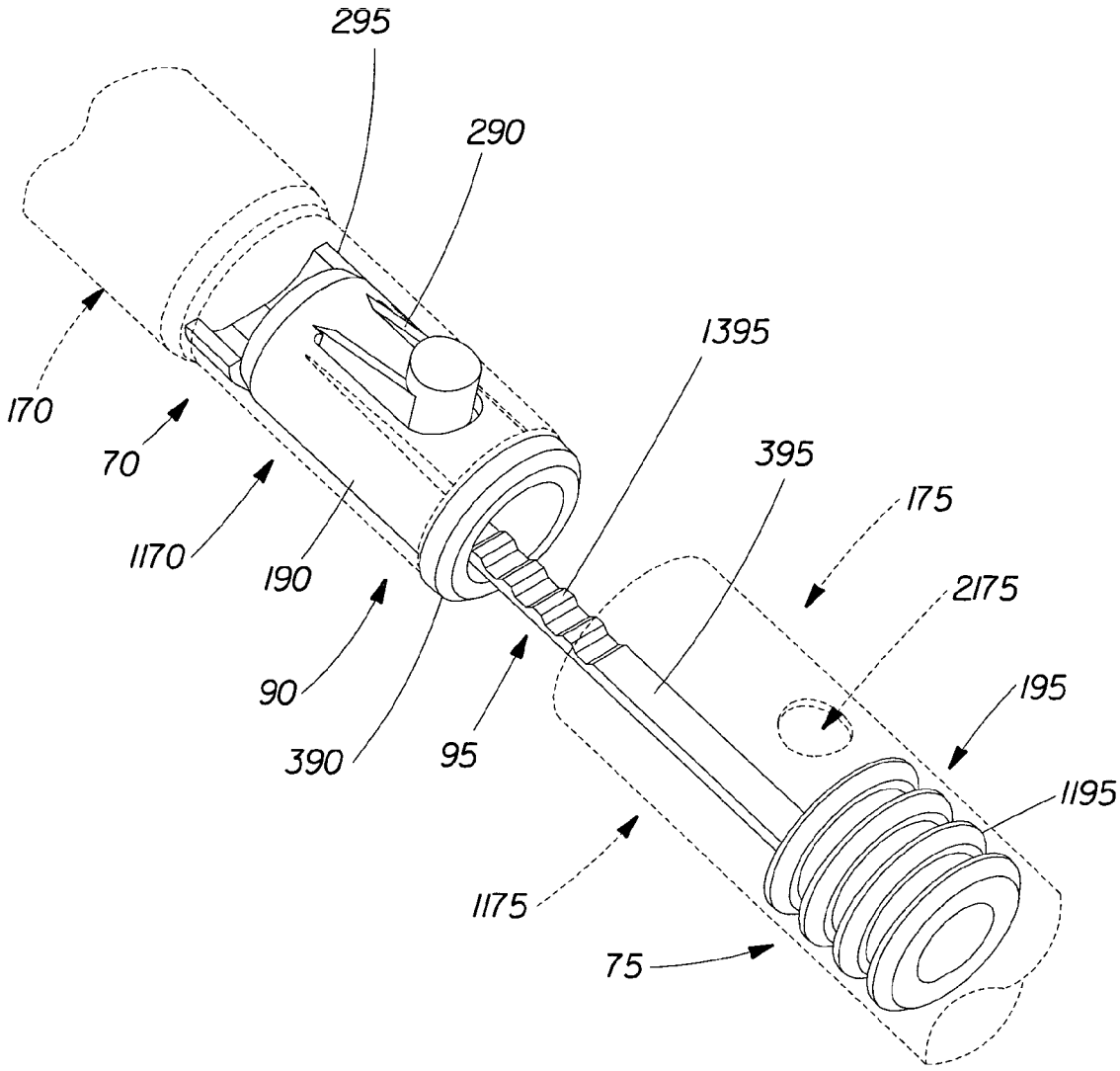
FIG. 12 is a partially cut-out isometric view of a locking member and a securing member of the present invention.
Figure 13:
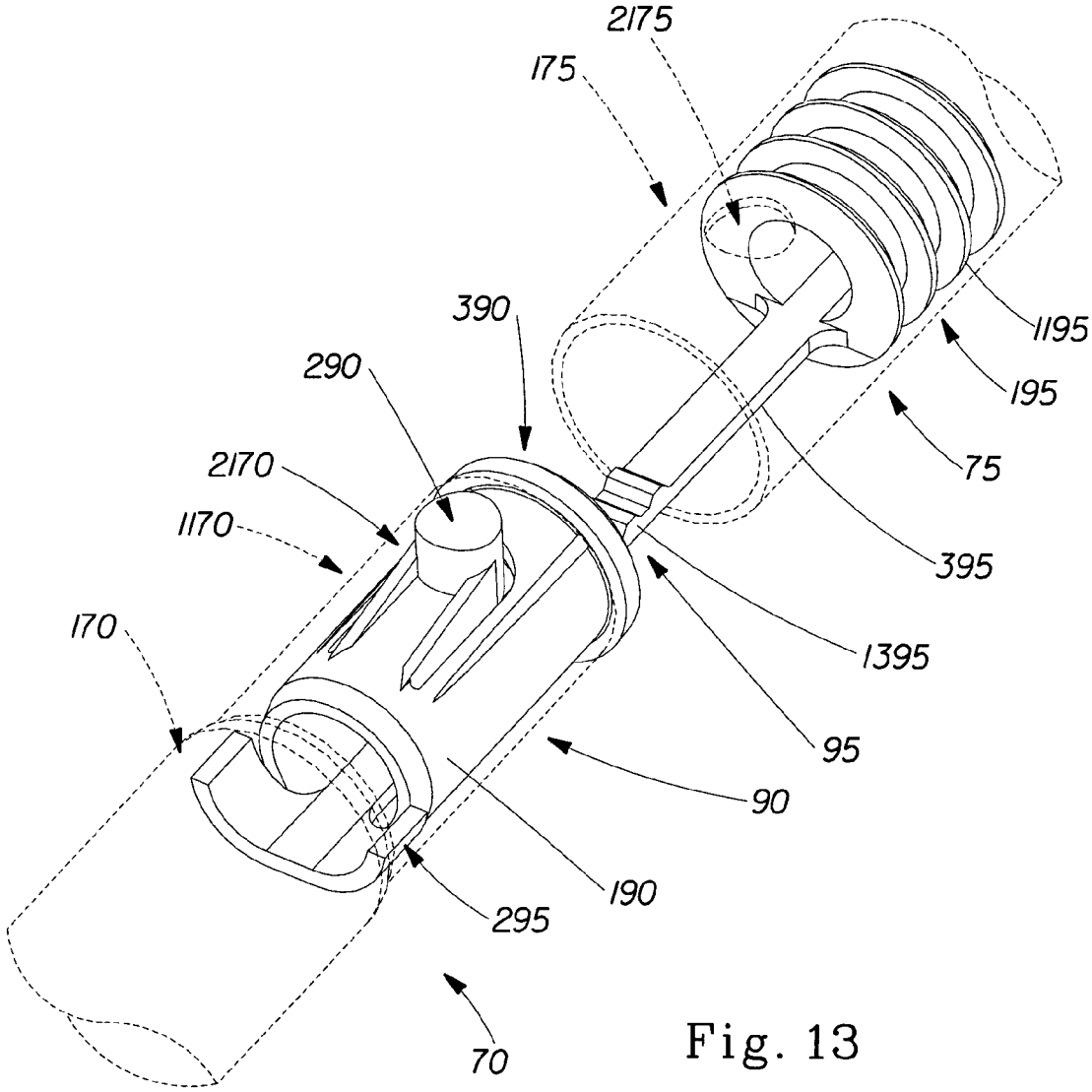
FIG. 13 is a partially cut-out isometric view of the locking member and the securing member of FIG. 12 viewed from a different angle.
Figure 14:
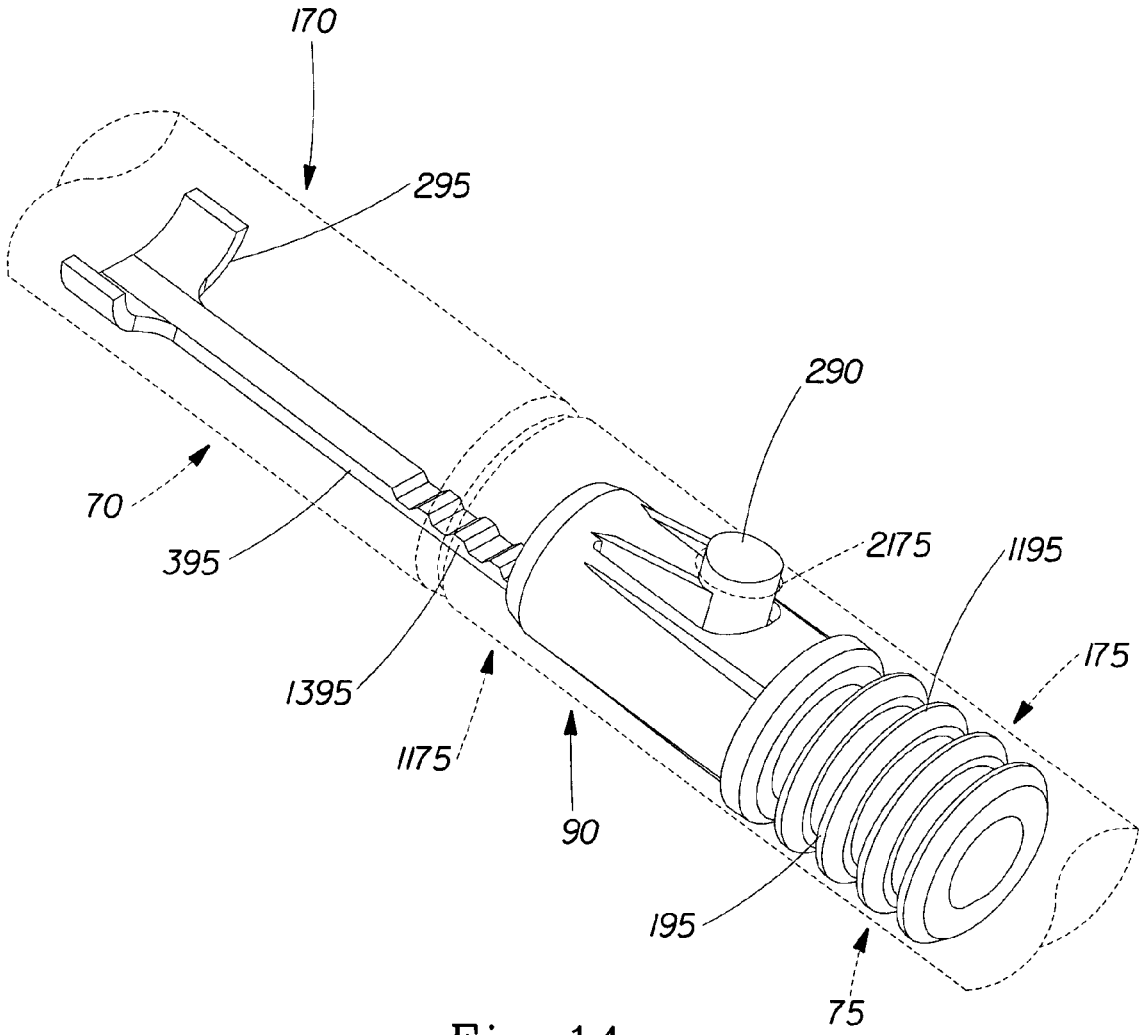
FIG. 14 is a partially cut-out isometric view of a locking member and a securing member of the present invention shown in a locked position.
Figure 15:
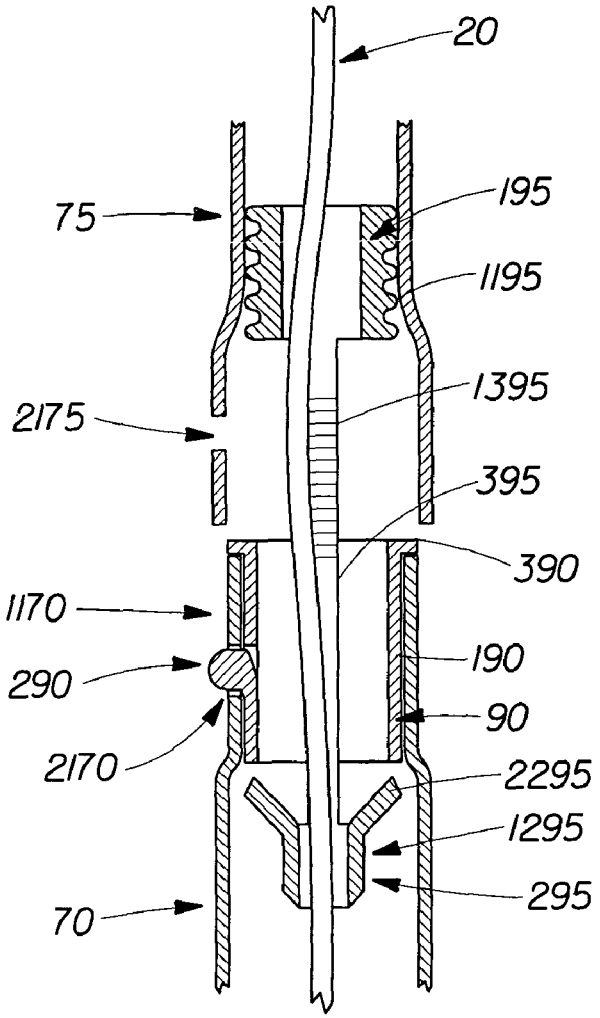
FIG. 15 is a cross section view of a locking member and another securing member.
Figure 16:
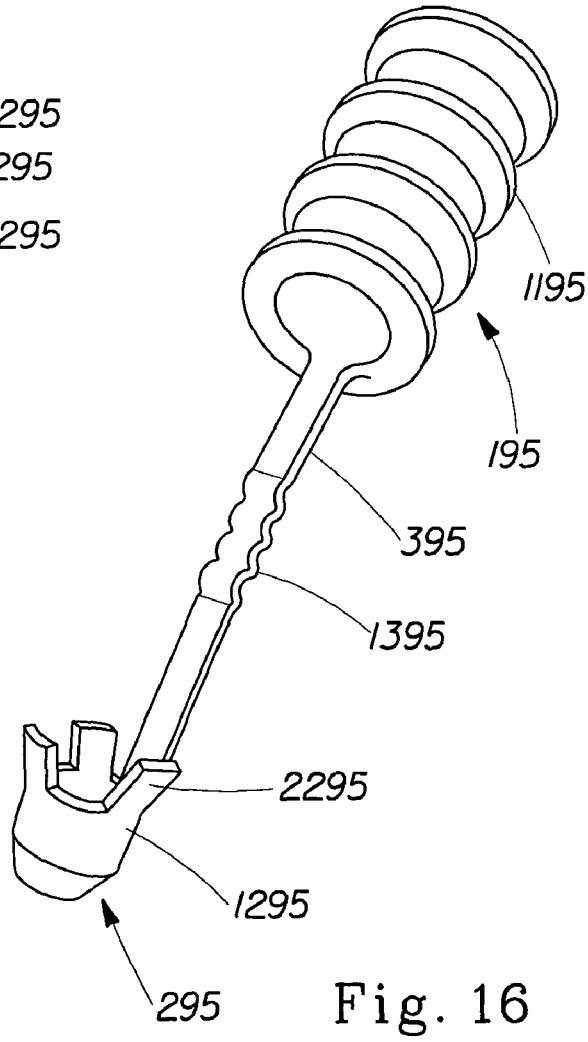
FIG. 16 is an isometric view of the securing member of FIG. 15.

Optionally but preferably, two consecutive pole segments 70 and 75 can also have a securing member 95 also represented in FIGS. 12, 13 and 14. This securing member can have a first retaining member 195 which is inserted within the female portion 1175 of the pole segment 75. This first retaining member 195 can be releasably or permanently attached to the inner surface of the pole member 75. In a preferred embodiment, the first retaining member 195 has a substantially cylindrical shape and can comprise at least one annular chevron member 1195 extending radially away from the outer surface of the first retaining member 195. In a preferred embodiment, the first retaining member 195 comprises a plurality of annular chevron members 1195, preferably between 2 and 10. In a preferred embodiment, the annular chevron member 1195 is made of a substantially flexible material and the diameter of the annular chevron member 1195 is slightly greater than the inner diameter of the pole segment 75 such that the tips or edges of the annular chevron member 1195 contacts the inner surface of the pole segment 75 when the first retaining member 195 is inserted within the female portion 1175 of the pole member 75. Without intending to be bound by any theory, it is believed that due to the "V" shape of the annular chevron member 95, the frictions between the annular chevron member 1195 and the inner surface of the pole segment 75 when the first retaining member is being withdrawn from the pole segment 75, are greater than the frictions between the annular chevron member 1195 and the inner surface of the pole segment 75 when the first retaining member is being inserted within the pole segment 75. In one embodiment, the force required to remove the first retaining member 95 from the pole segment 75 is at least 10 N, preferably at least 30N, even more preferably at least 50N. The first retaining member 195 can be connected to a second retaining member 295 via a connecting member 395 as shown in FIG. 13. In one embodiment, at least a portion 1395 of the connecting member 395 can be flexible such that this connecting member 395 can be bent, preferably folded, without substantially being damaged and/or rupturing. In one embodiment, the second retaining member 295 can have a substantially arcuate or curved shape and is preferably located in a plane substantially perpendicular to the connecting member 395. The second retaining member 295 is preferably made of a substantially flexible material. Non-limiting examples of suitable materials include plastics and preferably Co-Polymer Polypropylene. In one embodiment, the radius of curvature of the second retaining member 295 which can be defined by the radius of the circle passing through three distinct points located on the curved edge of the second retaining member 295 is greater than the inner radius of the substantially cylindrical body 190 of the locking member 90. One skilled in the art will understand that when pressure is applied to the flexible second retaining member 295, this member 295 can be resiliently deformed inwardly such that it can be threaded through the substantially cylindrical body 190 of the locking member 90 as well as the male portion 1170 of the pole member 70. When the second retaining member extends beyond the locking member 190 into the pole member 70, it returns at least partially to its original shape as shown in FIGS. 12, 13 and 14. As a result, when the male portion 1170 of the pole segment 70 is inserted in the female portion 1175 of the pole segment 75, the second retaining member 295 is free to move or slide within the pole segment 70 but it cannot be withdrawn form the pole segment 70 by a user without using a substantial amount of force. In one embodiment, a pulling force of at least about 10N, preferably at least about 30N, even more preferably at least about 50N is required to withdraw the second retaining member 295. In one embodiment, the distance between the first and the second retaining members 195, 295 is at least about 10 mm, preferably at least about 20 mm, more preferably at least about 40 mm. In one embodiment, the longitudinal member (not shown for clarity) can be threaded through the pole segments 70 and 75 having a locking member 90 and a securing member 95. In another embodiment represented in FIGS. 15 and 16, the second retaining member 295 can have a substantially hollow body 1295 connected to the connecting member 395. In a preferred embodiment, the hollow body 1295 comprises a least one but preferably a plurality of deflecting member(s) 2295 extending radially from the hollow body 1295. In a preferred embodiment, the deflecting member(s) 2295 is made of a substantially flexible material such that the deflecting member(s) can be resiliently and inwardly deflected when the hollow body 1295 is inserted within the locking member 90. When the hollow body member 1295 and the deflecting member(s) 2295 extend beyond the locking member 90, the deflecting member(s) 2295 returns to its original shape such that the second retaining member 295 cannot be extracted from the pole segment 70 without applying a substantial amount of force. The longitudinal member 20 can be threaded within the substantially hollow body 1295 of the second retaining member 295 and can be moved within the hollow body 1295.

Among other benefits, the securing member 95 either alone or in combination with a locking member 90, allows two consecutive pole segments 70, 75 to be conveniently "folded" as the securing member 95 is bendable. Another benefit can be that in the event a user would attempt to pull two consecutive pole segments which are not being attached and which could result in the longitudinal member being damaged, the securing member used with the locking member provide an intuitive signal to the user indicating that two consecutive pole segments should not be pulled too far apart. During shipping of the device as well as during the assembly of the pole segments by a user, the securing member 95 also prevents that the two pole segments get pulled apart by accident, which could result in damaging the longitudinal member 20. The securing member 95 also protects the longitudinal member 20 when the two pole segments are folded by limiting the frictions of the longitudinal member 20 against the edges at the end of the pole segments. During the assembly of two pole segments, the securing member 95 can also contribute to limit the risk that a user, who would not have read the instructions and would believe that the longitudinal member 20 needs to be severed prior to connecting two pole segments, from voluntarily severing the longitudinal member 20 as the longitudinal member 20 can be lying against the securing member 95.

Figure 17:
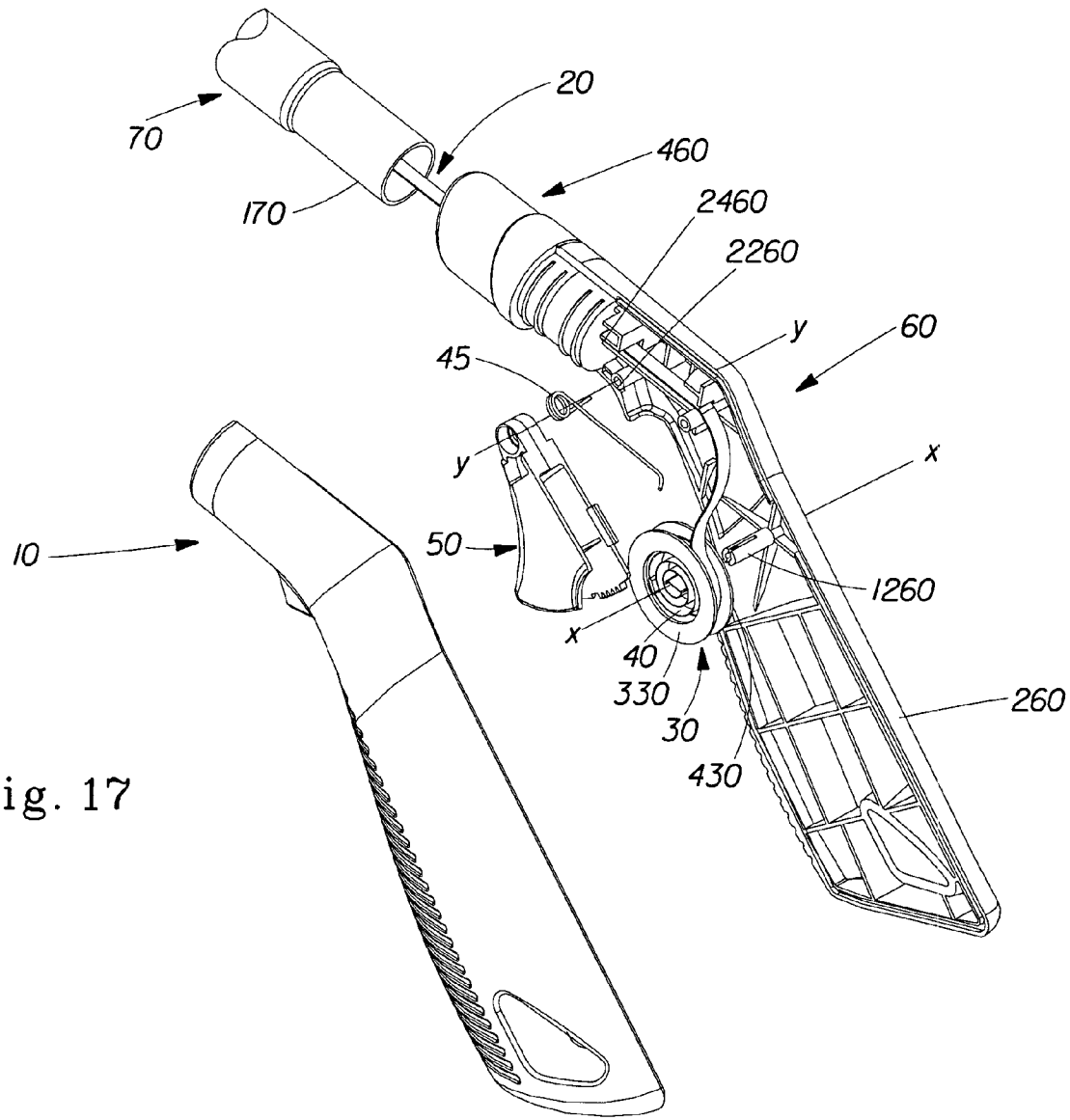
FIG. 17 is an exploded view of the device of FIG. 1 showing a blocking member.

In another embodiment represented in FIG. 17, the longitudinal member can have a blocking member 120 which is preferably fixedly attached to the longitudinal member 20. This blocking member 120 can be sized such that it cannot go through an opening 2460 of the connecting portion 460 of the housing 60. In a preferred embodiment, the opening 2460 can be sized such that it is slightly greater than the width and thickness of the tape 20. When the longitudinal member is a flexible tape, this blocking member can be located on this tape such that when the tape is tensioned by the spring member, less than about 20 cm, preferably less than about 10 cm, more preferably less than about 5 cm of the tape can move freely through the opening 2460 before the blocking member 120 reaches the opening 2460. This blocking member can be used alone or in combination with the locking and securing members previously described. Among other benefits, the blocking 20 member prevents the complete removal of the longitudinal member from the winding member. One skilled in the art will understand that the locking member 90 and/or the securing member 95 can also be used to safely assemble two pole segment 70 and 75 which do not include a longitudinal member 20.

Figure 18:
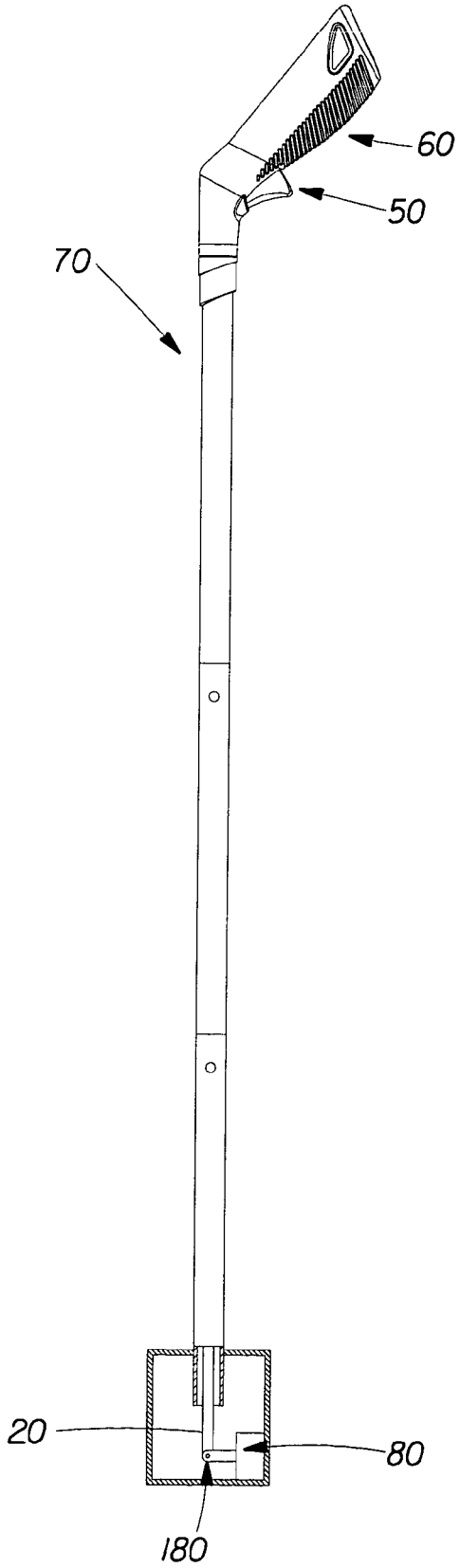
FIG. 18 is a partially cut-out front view of one embodiment of the present invention having an actuable mechanism.
Figure 19:
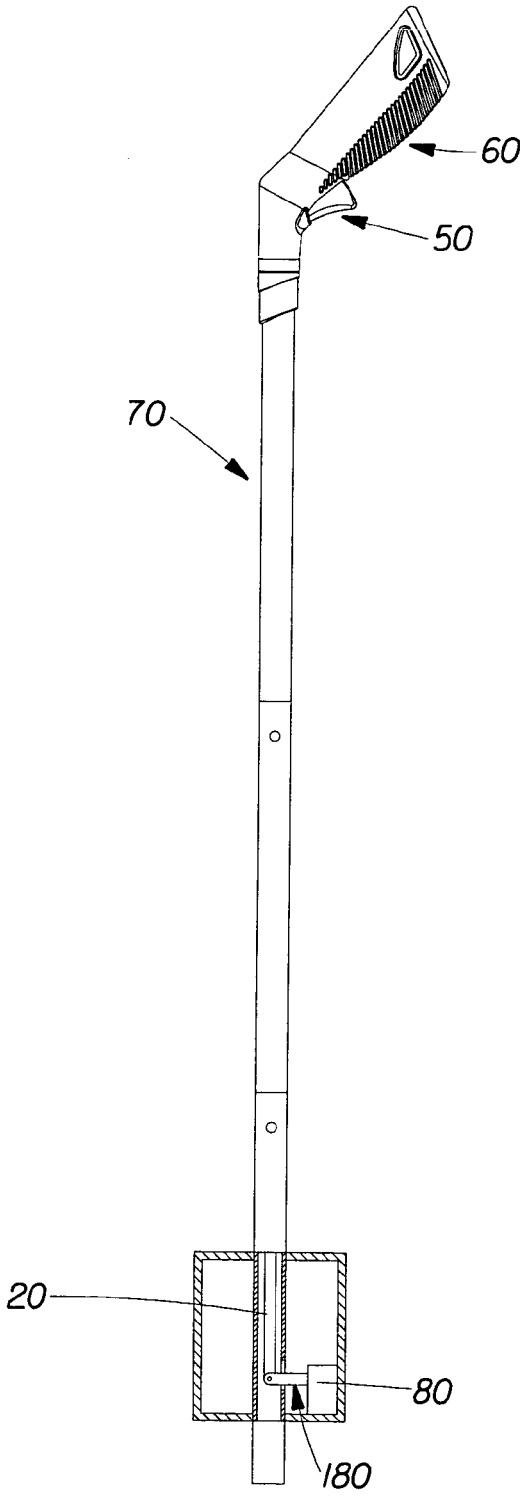
FIG. 19 is a partially cut-out front view of another embodiment of the present invention having an actuable mechanism.

In one embodiment, which is schematically represented in FIG. 18, the free end of the longitudinal member 20, i.e. the end of the longitudinal member which is located away from the winding member, can be attached to the actuating member 180 of an actuable mechanism 80. In one embodiment, the actuable mechanism can be attached to the second end of a pole segment 70 or 75 or any other pole segment of the device. In another embodiment, schematically represented in FIG. 19, the actuable mechanism 80 can be attached to a pole segment between its first and second end. In this embodiment, since the longitudinal member 20 is threaded through the pole segments 70, 75 it can be necessary to make an opening on the outer surface of a pole segment where the actuable mechanism 80 can be attached in order to attach the free end of the longitudinal member 20 to the actuating member 180 of the actuable mechanism 80 or to allow the actuating member 180 to extend within a pole segment 70 or 75.

It can be easily understood that when the pole segments 70 and 75 are not attached to each other, it is possible to fold the assembly previously described such that its total length is reduced, as previously shown in FIG. 11. As the longitudinal member can be substantially flexible, it can also be bent and preferably folded without being ruptured When the longitudinal member 20 is a flexible tape or cable, one skilled in the art will understand that the length of the tape and/or cable will preferably be greater than the sum of the useful lengths of the pole segments. By useful length of the pole segments, it is meant the sum of the length(s) of the pole segment(s) through which the tape and/or cable is threaded when the pole segments are not connected. For example, if the actuating mechanism 180 of an actuable device 80 or tool is located in the middle of a pole, the tape will need to be threaded through half this pole segment and the useful length of this pole segment is then half its total length. The useful length of an intermediate pole segment is the total length of this pole segment. When the pole segments, which have a male and a female portion, are progressively assembled by a user, the "slack" of tape, which in one embodiment is the result of the portion of the tape which is "folded" in addition to the length of the male portion of a pole segment which is inserted in a female portion, is immediately rolled back on the outer surface of the winding member 30 due to the reacting or recoil force of the coil spring 40. Once all the pole segments are assembled to form the handle of the device, the tape is immediately put under tension and the actuating mechanism 180 can be actuated by squeezing the trigger 50.

The actuable mechanism 80 can be any type of mechanism which needs to be actuated and preferably remotely actuated. As previously discussed, the longitudinal member 20 can be used such that actuation of the trigger member results in a pulling or releasing motion of the longitudinal member 20. In one embodiment, the previously described device for remotely actuating a mechanism can be used to actuate an electric switch connected to at least one battery and a motor. The free end of the longitudinal member 20 can be attached to the switch such that when the longitudinal member 20 is pulled, the switch is moved from an OFF to an ON position. The electric switch is preferably a spring loaded switch such that when the trigger 50 is pulled, the switch comes to the ON position and when the trigger is released, the switch returns to the OFF position. In another embodiment, the free end of the longitudinal member 20, can be attached to a spray mechanism comprising a squeezable pump for placing a fluid under pressure. In another embodiment, the longitudinal member 20 can be connected to a garden tool having at least one blade member for remotely cutting branches or grass or a tool having at least one rotatable arm member for picking-up leaves and/or dirt.

Figure 20:
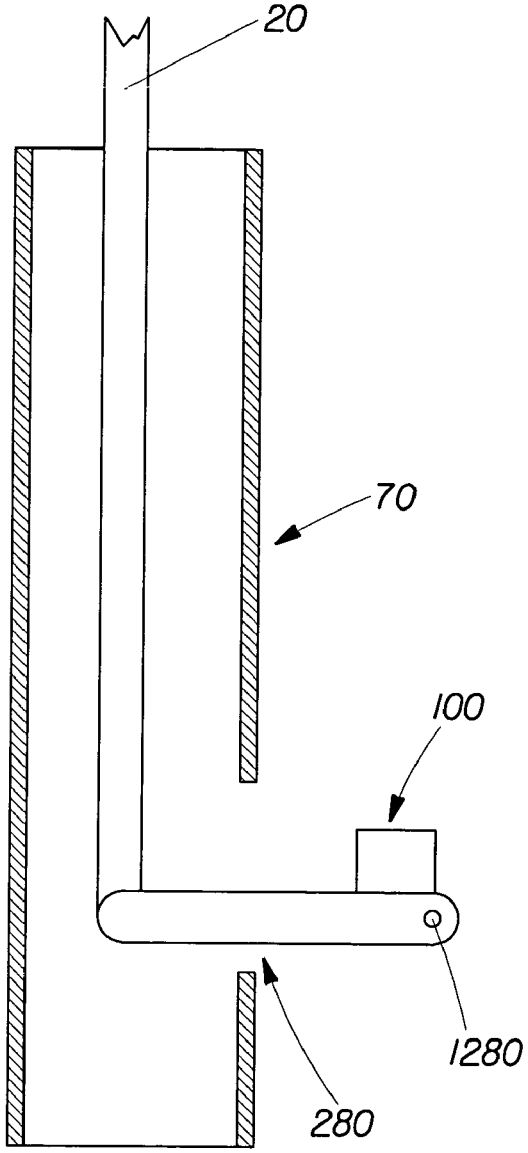
FIG. 20 is a cross section view of one embodiment of the invention having a lever member in a first position.
Figure 21:
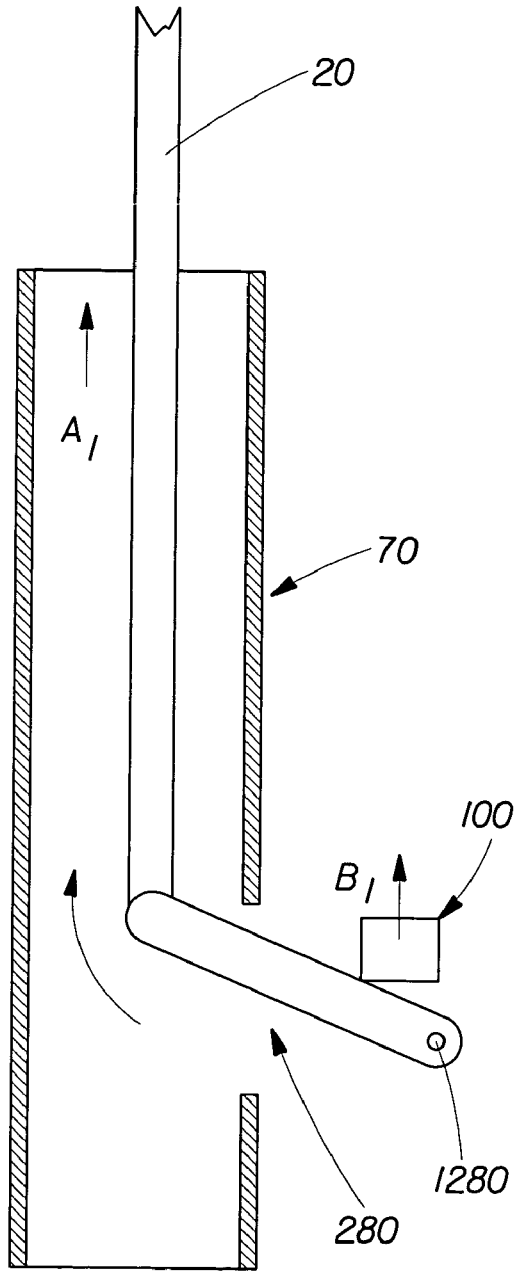
FIG. 21 is a cross section view of the mechanism shown in FIG. 20 where the lever member is in a second position.
Figure 22:
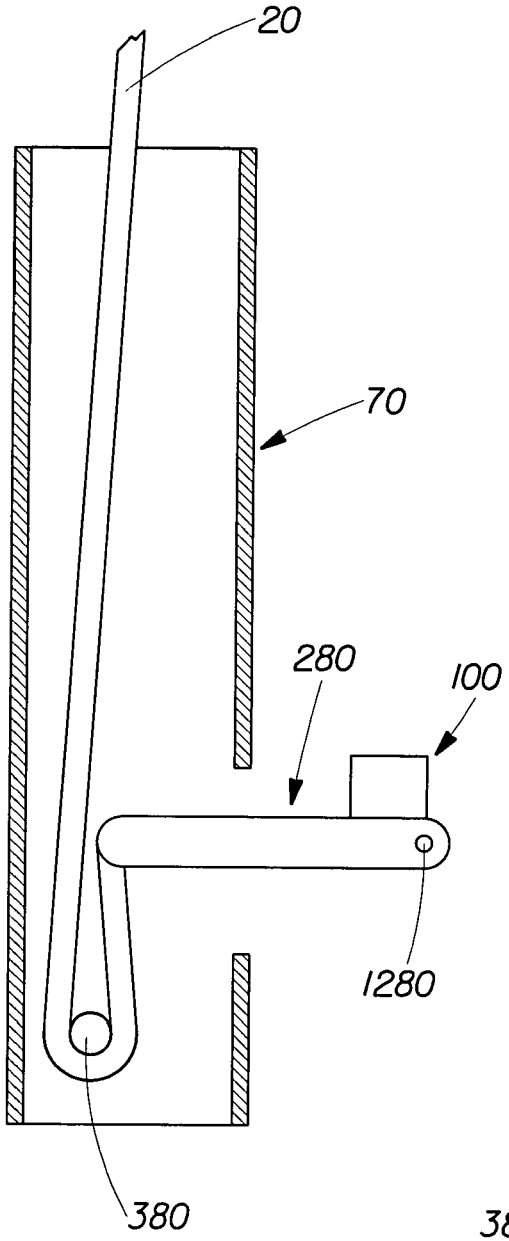
FIG. 22 is a cross section view of another embodiment of the invention having a lever member in a first position.
Figure 23:
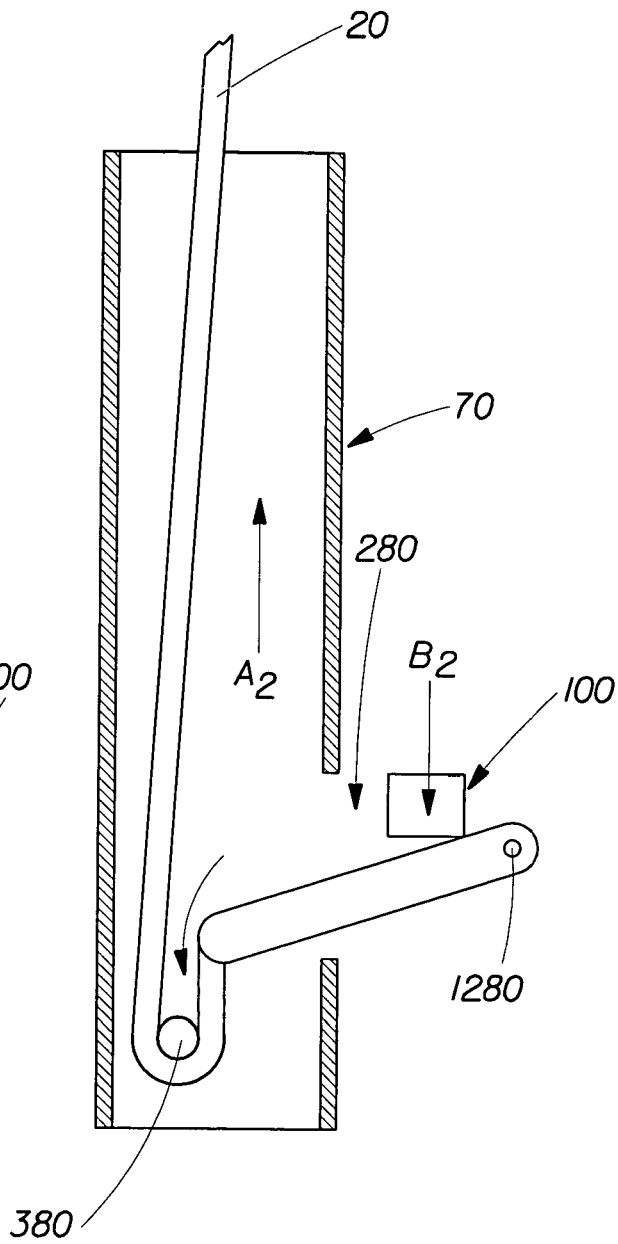
FIG. 23 is a cross section view of the mechanism shown in FIG. 22 where the lever member is in a second position.
Figure 24:
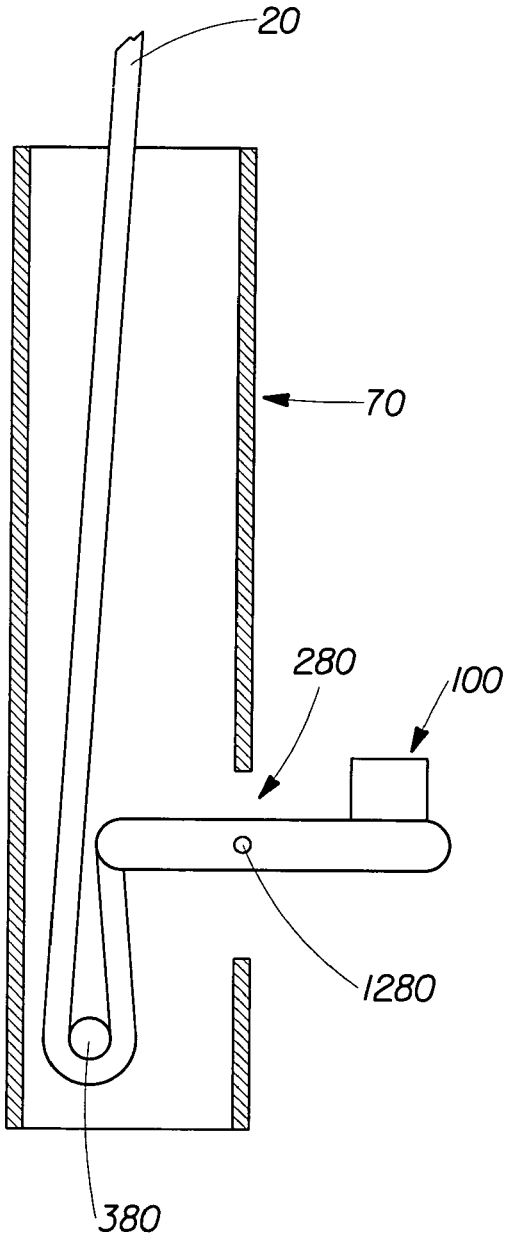
FIG. 24 is a cross section view of another embodiment of the invention having a lever member in a first position.
Figure 25:
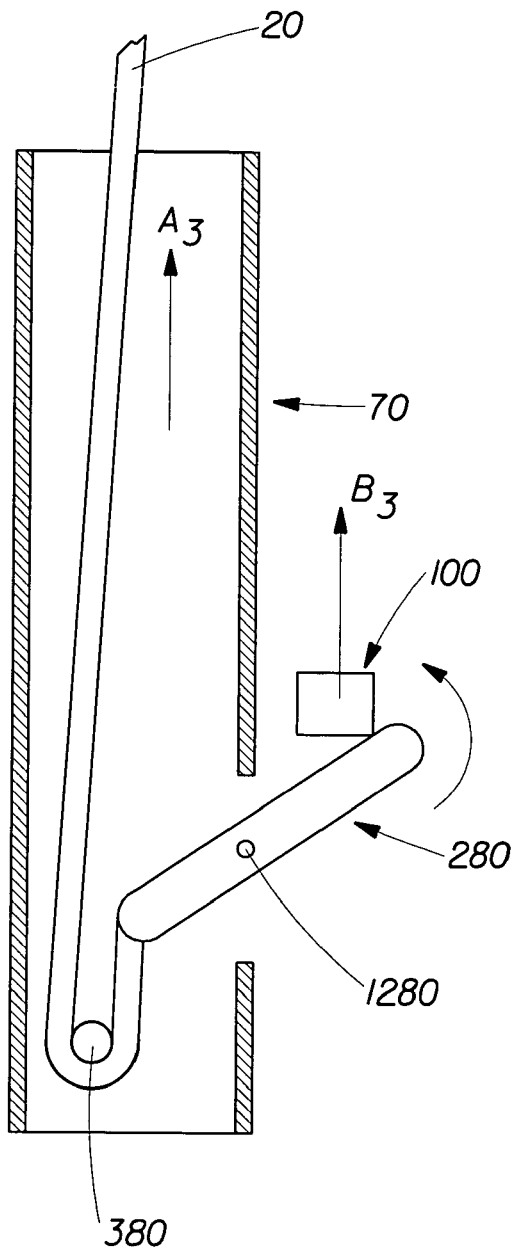
FIG. 25 is a cross section view of the mechanism shown in FIG. 24 where the lever member is in a second position.

In another embodiment, schematically represented in FIGS. 20–25, the free end of the longitudinal member 20 can be attached to a lever member 280 which can be rotationally attached to a pole segment 70, and/or 75 or which can be rotationally attached to a housing which can also be attached to the pole segment. In one embodiment, the lever member 280 can be connected to and can actuate a fluid delivery mechanism 100 which is schematically represented in FIGS. 20 though 25. A non-limiting example of a fluid delivery mechanism can be a gravity fed mechanism such as the one described in International Application serial No PCT/US01/09498 to Hall et al, assigned to the Clorox Company and filed Mar. 23, 2001 and which discloses a check valve which can be displaced by a lever member such that a liquid stored in a bottle flows by gravity. Another example of a fluid delivery mechanism can be the one described in U.S. Pat. No. 6,206,058 to Nagel et al, filed Nov. 9, 1998 and assigned to The Procter & Gamble Company and which discloses a vent and fluid transfer fitment having a venting check valve and a fluid transfer check valve. This fluid transfer check valve can have a tubular probe which allows a fluid stored in a reservoir to flow by gravity when the probe is moved from a first position to a second position. This tubular probe can be connected to a lever member such that the pulling of the longitudinal member results in the motion of the tubular probe from a first position where the fluid transfer check valve is closed, to a second position where the fluid delivery check valve is opened. Another example of suitable a fluid delivery mechanism is disclosed in copending U.S. application Ser. No. 60/409,263 to Höfte et al, filed Sep. 9, 2002, and assigned to The Procter and Gamble Company. The lever member 280 can also be connected to a pressurized type container such as an aerosol canister where the pulling or pushing motion of the lever member 280 results in the discharge of the fluid contained in the pressurized container. One skilled in the art will understand that depending on the type of motion that is required to actuate the fluid delivery mechanism, the longitudinal member 20 can be directly attached to the lever member 280 or can be looped on a pin member 380 as previously described and then attached to the lever member 280. One skilled in the art will also understand that different type of actuating motion can be obtained with the lever member 280 depending on the location of its the pivot point 1280. In one embodiment schematically represented in FIGS. 20 and 21, the longitudinal member 20 can be attached at one end of the lever member 280 and the pivot point 1280 can be located about the second end of the lever member 280. When the longitudinal member is pulled in a direction represented by the arrow A1 in FIG. 21, the lever member 280 rotates about its pivot point 1280 and the liquid delivery system is moved substantially upwards in a direction represented by the arrow B1. In another embodiment schematically represented in FIGS. 22 and 23, the longitudinal member is looped around a pin member 380 and attached at one end of the lever member 280. The pivot point 1280 of the lever member 280 can be located about the second end of the lever member 280. When the longitudinal member 20 is pulled as represented by the arrow A2, the lever member rotates about its pivot point 1280 and the liquid delivery system is moved substantially downward in a direction represented by the arrow B2 in FIG. 23. In still another embodiment schematically represented in FIGS. 24 and 25, the longitudinal member 20 can be looped around a pin member 380 and attached to the first end of the lever member 280. The pivot point 1280 can be located between the first and second ends of the lever member 280 such that when the longitudinal member is pulled in a direction represented by the arrow A3, the lever member 280 rotates about its pivot point 1280 and the fluid delivery mechanism 100 is moved substantially upwards in a direction represented by the arrow B3 of FIG. 25.

Figure 26:
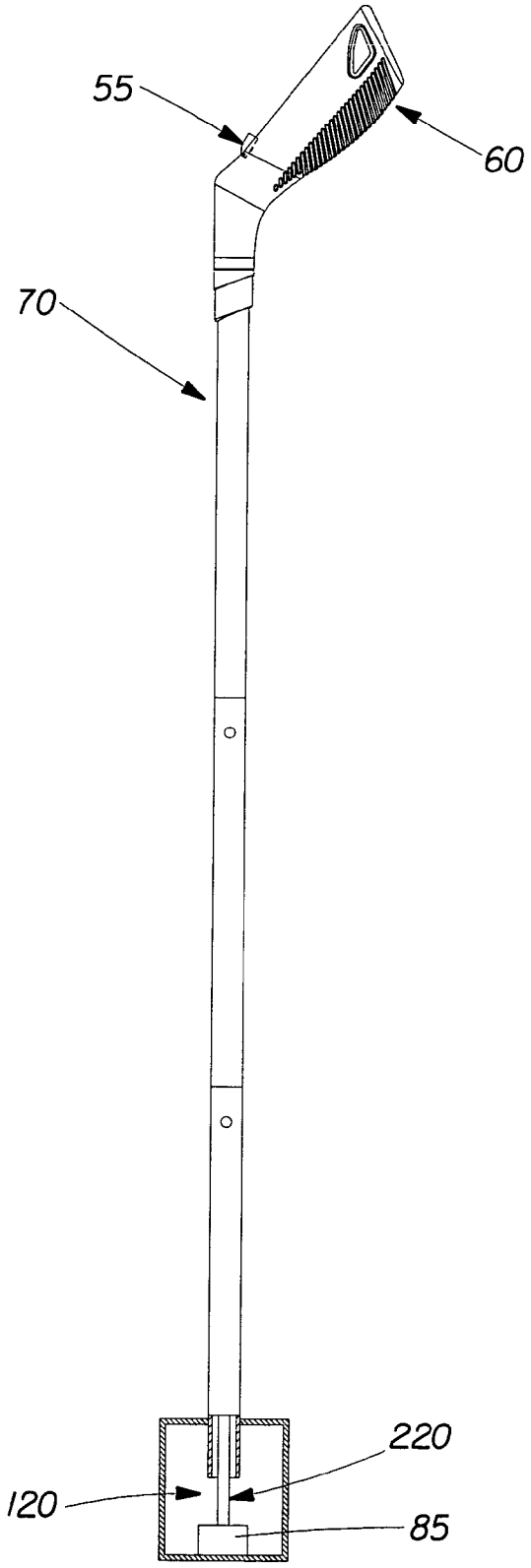
FIG. 26 is a partially cut-out front view of one embodiment of the invention.
Figure 27:
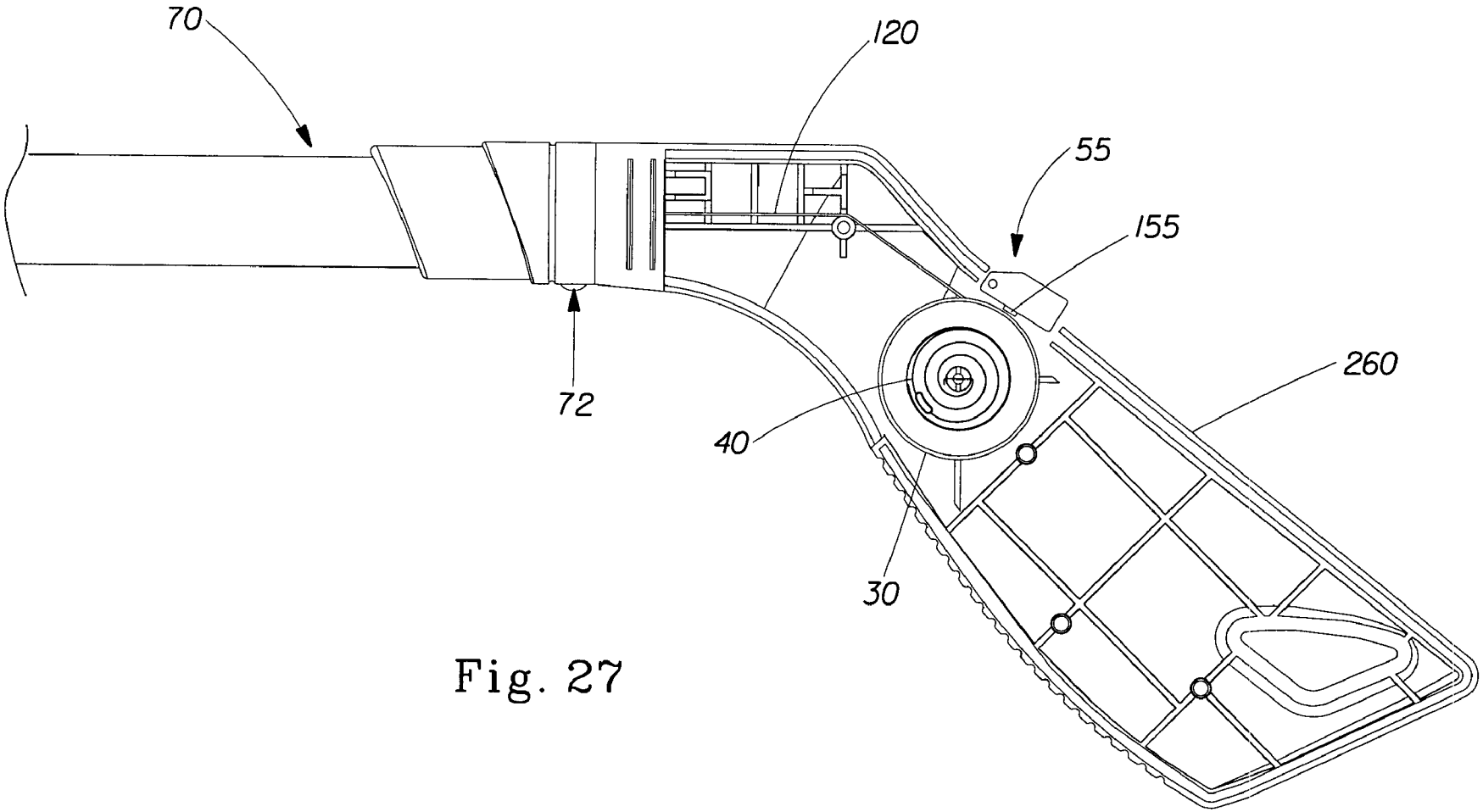
FIG. 27 is a front view of one embodiment of the invention where part of the housing has been removed for clarity; schematically

In another embodiment schematically represented in FIG. 26 and showing a finished mop assembly and in FIG. 27 showing the functional members within the housing, an actuating device 10 can comprise a housing 60 as previously described, pole segments as previously described, a winding member 30, a spring member 40, a longitudinal member 20 comprising at least a first and a second longitudinal conductive members 120, 220 and an electric switch 55. The winding member 30 can rotate about a rotational axis X—X which can substantially coincide with a protrusion member 1260 located on the inner surface of the left and/or right housing. The first end of a spring member 40 can be attached to the protrusion member 1260 and the second end of the spring member 40 can be attached to the winding member 30. In a preferred embodiment, the spring member 40 is a coil spring as previously described and the second end of the coil spring can be attached to the inner surface of the winding member 30. In one embodiment, the longitudinal member 20 comprises a first and a second longitudinal conductive member 120, 220 for conducting an electric current, as schematically represented in FIG. 26. The first end of the first and second longitudinal conductive members can be attached to the winding member 30 such that rotation of the winding member 30 results in the first and second longitudinal conductive members being rolled up on the outer surface of the winding member as previously described. The second end of the first and second longitudinal conductive members 120, 220 can be attached to an electric circuit 85. In one embodiment, this electric circuit can comprise a power source for powering electrical components such as an electric motor for driving a pump such as the one disclosed in U.S. patent application Ser. No. 09/831,480 to Policicchio et al filed Nov. 9, 1999 and assigned to The Procter & Gamble Company. In one embodiment, the first and second longitudinal conductive members 120, 220 can be a pair of electric cables electrically insulated from each other. One skilled in the art will understand that a pair of electric cables can be electrically insulated by coating each cable with a non-conductive material such as plastic or by keeping these cables separated such that an electric current cannot accidentally run from the first to the second cable. In another embodiment, the first and second longitudinal conductive members 120, 220 can be a first and a second strip of conductive material located on a flexible tape and being electrically insulated from each other with a non-conductive material. In a preferred embodiment, the at least two conductive longitudinal members 120, 220 are attached to the outer surface of the winding member 30 such that these longitudinal conductive members 120, 220 are concurrently rolled up on the outer surface of the winding member 30 while remaining electrically insulated from each other.

Figure 28:
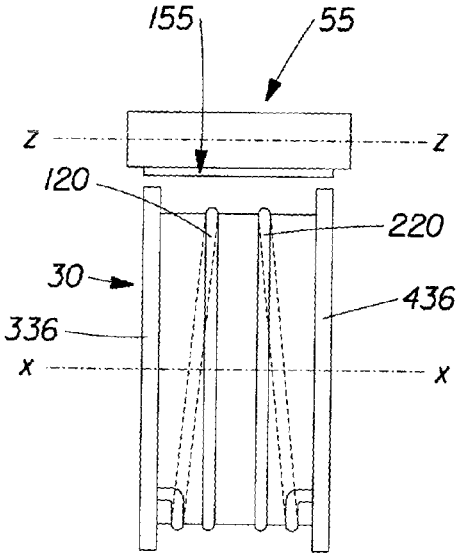
FIG. 28 is a schematic side view of the mechanism shown in FIG. 27 where the electric circuit is open.
Figure 29:
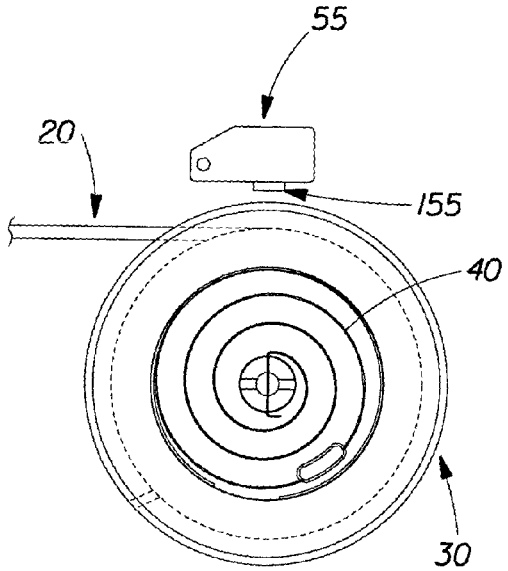
FIG. 29 is a schematic front view of the mechanism shown in FIG. 28.
Figure 30:
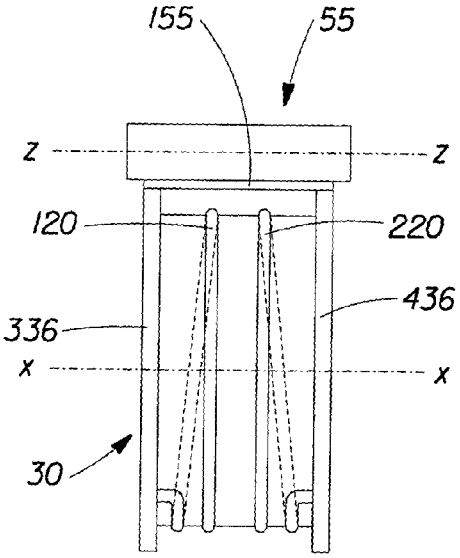
FIG. 30 is a schematic side view of the mechanism shown in FIG. 27 where the electric circuit is closed.
Figure 31:
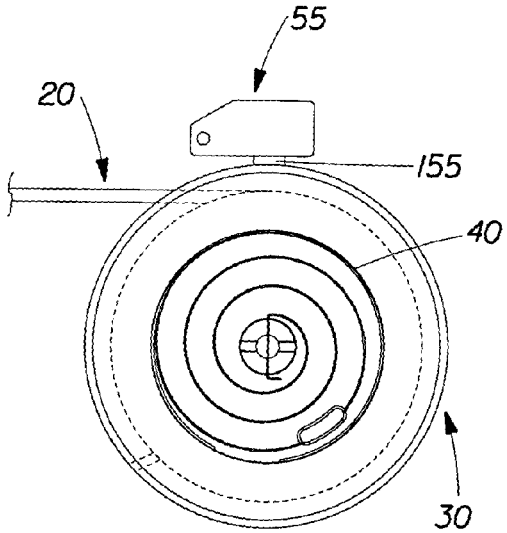
FIG. 31 is a schematic front view of the mechanism shown in FIG. 30.

In one embodiment, the winding member 30 comprises a first and a second conductive portion 336 and 436 which are preferably electrically insulated from each other. The first conductive portion 336 can be electrically connected to the first end of the first conductive longitudinal member 120 and the second conductive portion 436 can be electrically connected to the first end of the second conductive longitudinal member 220 as shown in FIGS. 28 and 30. In one embodiment, the housing 60 comprises an electric switch member 55 for closing the circuit formed by the first and second conductive longitudinal member 120, 220, respectively connected to the first and second conductive portions 336, 436 of the winding member 30 and the electric circuit connected at the second end of the first and second conductive longitudinal members 120, 220. The electric switch 55 can be moved from a first to a second position in order to close or open the electric circuit. In a preferred embodiment, the electric switch member 55 can be rotated about a rotational axis Z—Z which can be substantially parallel to the rotational axis X—X of the winding member 30 but one skilled in the art will understand that the electric switch member can also be moved distally as previously described and still provide the same benefits. In one embodiment, the electric switch 55 can be spring loaded such that it returns to its original position when a user stops applying pressure on the electric switch 55. In a preferred embodiment, the electric switch 55 can be located on the top portion of the housing 60 but it can also be located anywhere else on the housing 60 and still provide the same benefits. The electric switch member 55 can comprise a transversal conductive portion 155 which can removably contact the first and second conductive portions 336, 436 of the winding member 30 as shown in FIGS. 30 and 31. One skilled in the art will understand that when the transversal conductive portion 155 contacts both the first and second conductive portions 336 and 436, an electric current can run in the then closed electric circuit and the electrical elements of the electric circuit 85 are then powered. When the transversal conductive portion 155 cease to contact concurrently the first and second conductive portions 336, 436, as shown in FIGS. 27, 28 and 29, the electric current cannot run through the circuit and the electrical elements cease to be powered. In a preferred embodiment, the first and second conductive longitudinal members 120, 220 are threaded through a plurality of pole segments 70, 75. In a preferred embodiment, the length of the first and second conductive longitudinal members 120, 220 is greater than the useful length of the pole segments as previously described. As such, it is possible to "fold" each pole segment in order to reduce the length of the whole assembly. When a user whishes to assemble the handle, the user can simply attach each pole segment. The slack of the first and second conductive longitudinal members 120, 220 is then rolled up on the outer surface of the winding member 30. Among other benefits, the spring loaded winding member 30, prevents the first and second conductive longitudinal members 120, 220 from getting entangled. It also prevents the longitudinal members 120, 220 from getting pinched and potentially damaged or ruptured when two consecutive pole segments are attached. In one embodiment, the first and second conductive portions 336, 436 of the winding member 30 are substantially adjacent the edges of the winding member 30. In a preferred embodiment, the first and second conductive portions 336, 436 of the winding member 30 are each covering substantially annular portions of the winding member. One skilled in the art will understand that since the first and second conductive portions 336, 436 are located on the winding member 30, rotation of the winding member, for example when the pole segments are attached, will result in the rotation of the first and second conductive portions 336, 436. After rotation of the winding member 30, the first and second conductive portions 336, 436 may not be properly located to be concurrently contacted by the switch member 55. Among other benefits, a conductive portion 336 and/or 436 covering a substantially annular portion of the winding member 30 allow the switch 55 to electrically connect the first and second conductive portion 336 and 436 independently of the rotation of the winding member 30.

While particular embodiments of the subject invention have been described, it will be apparent to those skilled in the art that various changes and modifications of the subject invention can be made without departing from the spirit and scope of the invention. In addition, while the present invention has been described in connection with certain specific embodiments thereof, it is to be understood that this is by way of limitation and the scope of the invention is defined by the appended claims which should be construed as broadly as the prior art will permit.

What is claimed is:

1. A device for actuating a remote mechanism, said device comprising:

a housing having an orifice, said housing comprising:

i) a rotatable winding member, said winding member being rotatably connected to said housing;

ii) a spring member having a first and a second end wherein said first end is attached to said housing and said second end is attached to said winding member;

iii) optionally, means for rotating said rotatable winding member, said means being in communication with said winding member;

iv) a longitudinal member having a first and a second end wherein said first end is windably connected to said winding member and wherein said second end extends from said housing through said orifice and is attached to an actuable mechanism located remote from said housing; and a first pole segment communicating with said housing wherein said second end of said longitudinal member is located within said pole segment.

2. The device of claim 1 wherein said means for rotating said rotatable winding member is a trigger member having a motion actuating surface and a motion transferring surface, wherein said motion transferring surface rotates said winding member when pressure is applied to said motion actuating surface.

3. The device of claim 2 wherein said motion transferring surface of said trigger member comprises a plurality of projections with spaces in between for engaging respectively corresponding spaces and projections on said winding member.

4. The device of claim 3 wherein said trigger member is movably connected to said housing.

5. The device of claim 4 wherein said motion transferring surface has a substantially arcuate shape.

6. The device of claim 1 wherein said longitudinal member is substantially flexible.

7. The device of claim 6 wherein a portion of said longitudinal member is rolled up on said winding member.

8. The device of claim 2 wherein said longitudinal member moves from a first position to a second position within said pole member when pressure is applied to said actuating surface of said trigger member.

9. The device of claim 8 wherein said longitudinal member returns to said first position when pressure ceases to be applied to said actuating surface of said trigger member.

10. The device of claim 1 wherein said winding member has an inner and an outer surface and said spring member is a coil spring wherein the first end of said coil spring is attached to said housing and the second end of said coil spring is attached to said inner surface of said winding member.

11. The device of claim 1 further comprising a second pole segment releasably and foldably attached to said first pole segment such that said longitudinal member passes through said first and said second pole segments.

12. The device of claim 11 wherein the length of said longitudinal member is greater than the useful length of said first and second pole segments.

13. A device for remotely closing an electric circuit, said device comprising:

a housing, said housing comprising:

a rotatable winding member, said winding member being rotatably connected to said housing;

a spring member having a first and a second end wherein said first end is connected to said housing and said second end is connected to said winding member;

a conductive longitudinal member having a first and a second end, said longitudinal member comprising a first and a second longitudinal conductive portion, wherein said first and second conductive portions are electrically insulated from each other and wherein said first end of said conductive longitudinal member is windably connected to said winding member and wherein said second end is electrically connected to an electrically powered mechanism;

a switch member, wherein said switch member is electrically connectable to said first and said second conductive portions of said longitudinal member;

a first pole segment attached to said housing wherein said conductive longitudinal member is located within said pole segment.

14. The device of claim 13 wherein said longitudinal member comprises a first and a second electric cable.

15. The device of claim 14 wherein a portion of said first and said second electric cables is rolled up on said outer surface of said winding member.

16. The device of claim 15 further comprising a second pole segment releasably attached to said first pole segment such that said first and second cables are located within said first and said second pole segments.

17. The device of claim 16 wherein the length of said first electric cable and the length of said second electric cable is greater than the useful length of said first and second pole segments.

18. A locking and securing mechanism for connecting two tubular pole segments, said mechanism comprising:

at least a first pole segment having a substantially tubular shape, an inner surface and an outer surface, said first pole segment comprising a male portion and an opening extending radially through said male portion;

at least a second pole segment having a substantially tubular shape, an inner surface and an outer surface, said first pole segment comprising a female portion and an opening extending radially through said female portion;

a locking member comprising a body, a protrusion resiliently connected to said body, wherein said locking member is located substantially within said male portion of said first pole member such that said protrusion extends through said opening of said male portion and such that said protrusion is at least partially extendable through said opening of said female portion; and a securing member comprising a first retaining member attached to the inner surface of said second pole segment, said first retaining member being connected to a second retaining member wherein said second retaining member is slideably movable within said first pole segment.

19. The locking and securing mechanism of claim 18 wherein said first and said second retaining member are flexibly connected via a substantially flexible connecting member.

20. The locking and securing member of claim 19 wherein said substantially flexible connecting member is bent such that said first pole segment is substantially parallel to said second pole member.

21. The locking and securing mechanism of claim 18 wherein said first retaining member comprises a substantially annular chevron member.

22. The locking and securing mechanism of claim 18 wherein said second retaining member has a substantially arc shape.

23. The locking and securing mechanism of claim 22 wherein said second retaining member is substantially flexible.

24. The locking and securing member of claim 18 further comprising a longitudinal member located within said first and said second pole segments.

* * * * *